US011185730B2

(12) United States Patent
Brendle

(10) Patent No.: US 11,185,730 B2
(45) Date of Patent: Nov. 30, 2021

(54) NEUROMUSCULAR ACTIVATION VERTICAL EXERCISE DEVICE AND METHOD

(71) Applicant: Douglas Brendle, Cheyenne, WY (US)

(72) Inventor: Douglas Brendle, Cheyenne, WY (US)

( * ) Notice: Subject to any disclaimer, the term of this patent is extended or adjusted under 35 U.S.C. 154(b) by 80 days.

(21) Appl. No.: 16/834,430

(22) Filed: Mar. 30, 2020

(65) Prior Publication Data

US 2020/0222743 A1 Jul. 16, 2020

Related U.S. Application Data

(63) Continuation of application No. 15/656,251, filed on Jul. 21, 2017, now Pat. No. 10,603,536.
(Continued)

(51) Int. Cl.
*A63B 21/068* (2006.01)
*A63B 21/00* (2006.01)
(Continued)

(52) U.S. Cl.
CPC ..... *A63B 21/068* (2013.01); *A63B 1/00* (2013.01); *A63B 1/005* (2013.01); *A63B 21/065* (2013.01);
(Continued)

(58) Field of Classification Search
CPC ..... A63B 21/068; A63B 1/005; A63B 21/065; A63B 21/4035; A63B 21/4007; A63B 23/1218; A63B 21/156; A63B 1/00; A63B 21/00185; A63B 21/0023; A63B 2225/093; A63B 24/0062; A63B 26/003; A63B 21/00196; A63B 2225/10; A63B 24/0087; A63B 2225/09; A63B 71/0054; A63B 21/00181
See application file for complete search history.

(56) References Cited

U.S. PATENT DOCUMENTS 3,128,094 A 4/1964 Wolf
3,874,657 A 4/1975 Niebojewski
(Continued)

OTHER PUBLICATIONS

"Fitwall—Global Impact", National Fitness Trade Journal, Winter 2011, p. 26-27.
(Continued)

*Primary Examiner* — Andrew S Lo
(74) *Attorney, Agent, or Firm* — Polson Intellectual Property Law, PC; Margaret Polson; Christopher Sylvain

(57) ABSTRACT

A vertical exercise device for triggering sympathetic and/or parasympathetic system responses comprising at least one foot support and a handlebar assembly. The foot support(s) may have a support surface configured to contact the entire ball of a user's foot during use, which may be inclined at an angle and substantially flat. The handlebar assembly may have at least an upper handle configuration and a lower handle configuration, and be adapted to keep a user's wrist within a safe range of motion during use. The positioning and orientation of foot support(s) and the handlebar assembly may each be independently adjustable in various aspects, such as horizontal and vertical displacement, rotation, tilt, angle, etc. The angle and depth of the support surface may each be independently adjustable. A horizontal vibration system may move one or more components of the device along the horizontal plane. Handlebars may have thumb plates to restrict grip.

20 Claims, 19 Drawing Sheets

Related U.S. Application Data

(60) Provisional application No. 62/365,860, filed on Jul. 22, 2016.

(51) Int. Cl.
*A63B 1/00* (2006.01)
*A63B 23/12* (2006.01)
*A63B 21/065* (2006.01)

(52) U.S. Cl.
CPC ..... *A63B 21/156* (2013.01); *A63B 21/4007* (2015.10); *A63B 21/4035* (2015.10); *A63B 23/1218* (2013.01); *A63B 2225/093* (2013.01)

(56) References Cited

U.S. PATENT DOCUMENTS

| | | | |
|---|---|---|---|
| 4,927,135 | A | 5/1990 | Nieppola |
| 5,312,313 | A | 5/1994 | Holmes et al. |
| 6,514,178 | B2 | 2/2003 | Vettor |
| 6,626,801 | B2 | 9/2003 | Marques |
| 6,709,365 | B2 | 3/2004 | Zeilinger |
| 7,056,266 | B2 | 6/2006 | Sudeith |
| 7,520,838 | B1 | 4/2009 | Sudeith et al. |
| 7,524,269 | B2 | 4/2009 | Postma et al. |
| 7,611,444 | B1 | 11/2009 | Sudeith |
| D607,519 | S | 1/2010 | Calvin |
| 7,731,632 | B2 | 6/2010 | Wu |
| 7,762,928 | B2 | 7/2010 | Meissner |
| 8,147,389 | B1 | 4/2012 | Hoole |
| 9,132,330 | B2 | 9/2015 | Brendle |
| 10,603,536 | B2 | 3/2020 | Brendle |
| 2002/0019297 | A1 | 2/2002 | Vettor |
| 2002/0169052 | A1 | 11/2002 | Godsey |
| 2003/0060333 | A1 | 3/2003 | Sudeith |
| 2004/0058788 | A1 | 3/2004 | Thompson |
| 2005/0245355 | A1 | 11/2005 | Brewer et al. |
| 2008/0293547 | A1 | 11/2008 | Moy et al. |
| 2009/0156377 | A1 | 6/2009 | Brown |
| 2012/0329626 | A1 | 12/2012 | Meredith et al. |
| 2013/0184124 | A1 | 7/2013 | Reed |
| 2014/0371036 | A1 | 12/2014 | Ellis |
| 2015/0217156 | A1 | 8/2015 | Meredith et al. |
| 2015/0297948 | A1 | 10/2015 | Meister et al. |
| 2016/0213971 | A1 | 7/2016 | Jones |
| 2017/0157450 | A1 | 6/2017 | Anderson |
| 2017/0197132 | A1 | 7/2017 | Bowers |
| 2017/0312564 | A1 | 11/2017 | Perez Gomez |
| 2018/0021623 | A1 | 1/2018 | Brendle |

OTHER PUBLICATIONS

"The World's Top 10 Mist Innovative Companies in Fitness", Fast Company Newsletter, Feb. 13, 2014.
FightWall brochure, Brendle Systems, 2010.
Fitwall brochure, Brendle Systems, 2011.
"Fitwall: The New Edge of Fitness", National Fitness Trade Journal, Special Edition 2011, p. 38-39.
Fitwall article, National Fitness Trade Journal, Fall 2012, p. 30-31.
"Fitwall Opens a New Frontier", National Fitness Trade Journal, Summer 2012, p. 42-44.
"Fitwall: Join the Revolution", National Fitness Trade Journal, Winter 2012, p. 18-19.
"The Hottest New Fitness Tool Since rthe Stationary Bike", Women's Health online, Feb. 7, 2014.

NEUROMUSCULAR ACTIVATION VERTICAL EXERCISE DEVICE AND METHOD

BACKGROUND

Exercise is typically done on a horizontally based surface, for example the ground, floor, seat or bench, done standing or seated, and using weights or resistance machines. These methods are very limiting as they are completely dependent on voluntary activation and recruitment of muscles to do the movement required of a particular exercise. Humans are horizontal animals and designed to balance and move through balance supported and stabilized by a horizontal surface or resistant force.

Because we are designed to balance and move on the horizontal plane, we are neurologically comfortable doing it, and function in the parasympathetic nervous system when moving or exercising normally. Equilibrium is autonomic and sustained constantly with very little effort or thought, as muscles extend and contract reflexively if equilibrium is threatened to quickly reestablish equilibrium. Horizontal exercise and movements all require the body to be supported against gravity forces pulling us straight down toward the earth and equilibrium can be comfortably achieved with as little as one foot or hand being located directly under the body's center of balance (torso), and further stabilized with more than one foot or hand, or both, or all. The position of the torso over or between the horizontal supports or props is the primary determining factor for attaining equilibrium.

That being said, horizontal stability, equilibrium, can be recognized by the inner ear and autonomic nervous system by having the horizontal support being directly under the torso, or the torso between the two of more supports, in such a manner like the seat of a chair or bench in contact with the gluten or buttocks, or under the back or chest or side if you are laying down flat, or both the buttocks and the back if seated at an incline. The upward forces of buoyancy when in the water produce horizontal support, and with the addition of the surrounding pressure of the water around the body, it literally takes less muscle activation and recruitment to acquire recognizable horizontal stability than standing on the ground. Exercises such as body weight pull-ups also fall under the category of horizontal exercise, as all the resistant forces to the body are moving upward from directly below the torso, and the direction of fall the body is experiencing is straight down with no angular forces applied and recognized by the nervous system.

If when doing pull-ups you simply let go, the body will fall uninterrupted straight down to the floor or next horizontal support. While hanging on to the bar when doing pull-ups, the bar is providing a horizontal support force that is directly above the torso giving the same stimuli to the inner ear as if the support force was directly under the torso, and because this follows the rules of equilibrium the body stays in the parasympathetic nervous system during the exercise. The body is used to momentary threats to equilibrium, and autonomically responds to them to regain equilibrium by extending or contracting the few muscles it requires to recruit to reposition the torso into balance. The body's response is normal and comfortable, and the body does all its normal responses to momentary threats to equilibrium within the parasympathetic nervous system regardless to how physically intense the stimuli or response may be.

Horizontal movements and exercises, including swimming, require and are limited to only 1 to 10 muscles to be activated and recruited on any one side of the body to perform and control the movement while maintaining equilibrium. With one of the largest objectives to exercising being weight/fat loss, and having only 10 of over 600 motor movement muscles in the body recruited, horizontal exercise is not very efficient for consuming calories very quickly. This requires a person to exercise for long periods of time each day to lose a minimal amount of fat if measured in kcals per minute.

Muscle being the major consumer of kcals per minute, the more muscles being activated and recruited at the same time the more kcals will be consumed. For example, if you weigh 140 pounds, have an average body mass index, and exercise recruiting 10 muscles simultaneously at 85% of your max heart rate, and each muscle averaged 0.001 kcal per minute of caloric consumption, at best on the horizontal based exercise you would consume 10 calories per minute, 100 calories per 10 minutes of exercise, or 600 calories per hour.

This is not to say that at 85% of your max heart rate during exercise you will burn 100 calories in 10 minutes, because the real determining factor is how many muscles are being recruited during the exercise. For example, if you do an exercise that recruits only 3 muscles simultaneously at 85% max heart rate, you will only consume 30 calories in 10 minutes respectively. The heart supplies blood with glucose and oxygen to burn to all the muscles in the body every heart beat, regardless to how many of them are consuming. So if we were able to exercise at 100% our max heart rate we would be limited to consuming 150 calories per 10 minutes at the same 140 pounds of body weight. This may sound good until you consider how much more could be consumed if we could recruit more muscles simultaneously.

Over the last several decades, the major improvements to the horizontal exercises and horizontal-based apparatuses have still remained limited to only being able to activate the same few muscles or muscle chains at any given time, and because of the nature of horizontal exercise, the parasympathetic nervous system is in charge of the body's functions and resources.

Within the last half decade, it has been proven that for exercise done on a vertical surface with only you being the means of attachment and your torso positioned in such a manner that the torso cannot get directly over a horizontal support (such as the feet, hands, both, or between two or more), and therefore cannot establish and recognize horizontal stability. With the forced incorporation of at least one upper limb to maintain the body's position in space (such as one finger), for more than an instant/momentary period of time, the body will then physically confirm an ongoing threat to equilibrium, go into a defensive neurological response and shift into the sympathetic nervous system to take over the functions and responses of the body until the threat is terminated. This sympathetic response trigger by vertical exercise was confirmed using a Polar rs800CX and R-R recorder to conduct time domain heart rate variability (HRV) analysis. This sympathetic response is similar to the flight or fight responses, but without the negative cortisol and adrenal responses and side effects. The clean sympathetic response has been found to be uniquely produced while doing proper and controlled vertical exercise, and has tremendous benefits when it is possible to do it regularly and several times per week for months. But a traditional apparatus does not have the required geometry to allow the user to use it long term without reaching a point where it begins to hurt or injure critical joints and forces the user to terminate use.

A very positive effect of proper vertical exercise is the sympathetic response to the constant physical threat to equilibrium and the involuntary activation of the vast majority of the 600+ motor muscles in the body. The voluntary activation of a muscle doing horizontal exercise is directly linked to the simultaneous recruitment of muscles required for the movement. However, the sympathetic response experienced when doing proper vertical exercise can activate muscles independent of any recruitment of muscle. "Activation" is the muscle being turned on (neurological connection established) but not put into use or motion, and "recruitment" is when the muscle is put into action or use by either extension of contraction. Activation is like a vehicle engine being turned on and idling, and recruitment being the engine put into gear and pressure being applied to the accelerator causing movement or forces to be produced.

Like an engine running idle, the activated muscles on call made ready for action are burning energy, fuel in the vehicle and glucose in the body. In turn, all the activated motor muscles are consuming at least a measurable amount calories per minute or while activated without much of an elevation of heart rate when physically shifted into the sympathetic nervous system.

Referring back to the flight or fight response, the nervous system is shifted into the sympathetic nervous system starting with an emotional trigger or assumption that there is a threat. While the conscious mind assumes the threat is real, the blind and deaf autonomic nervous system fights going sympathetic and pushes back into the parasympathetic because it cannot physically confirm a threat with a loss of body fluid, temperature change or loss of balance, to cite just a few neurological conditions constantly monitored by the body. The emotional assumption of the conscious mind pushes back again into the sympathetic, and back and forth until there is a physical confirmation of a real physical threat. Once the threat is physically confirmed, the sympathetic response stays constant until the threat is then confirmed terminated. But an emotionally triggered sympathetic response is accompanied with a negative adrenal response and increase of alpha amylase and cortisol, along with many other negative effects that can last minutes if not days after the fight-or-flight experience. The depth or level of sympathetic response is also limited by the nervous system's central governing control working to preserve resources every way possible.

On the opposite side of the sympathetic nervous system, if the sympathetic response is triggered first only by a confirmed physical threat with no emotional influence, the sympathetic response is clean and free of the negative adrenal response, increased alpha amylase and cortisol, and other negative side effects. In contrast, the physically triggered sympathetic response is immediate and at a higher level, and produces positive benefits related to the conditioning of the body and neuromuscular re-education.

Currently available devices that vertical exercise can be practiced with, while evolving, are lacking in many ways. Existing vertical exercise apparatus can cause sympathetic responses, but the sustainability of the modality is limited by the design and configuration leading to musculoskeletal performance and ergonomic detriments that can lead to injury over time.

Existing vertical exercise apparatuses do not consider or accommodate the subtle and vast differences from person to person using the apparatus. The height of a person, the distance between joints and torso length, and range of motion for a muscle and a chain of muscle all differ from person to person. The amount of joint extension, flexion, hyperextension, supination, pronation, rotation, circumduction, adduction and abduction during body movements vary between people and have a large effect on the longevity of the practice of vertical exercise and the potential benefits versus the risks.

These characteristics of typical vertical exercise apparatus limit the performance and potential benefits that can be enjoyed from proper and sustainable vertical exercise. Current vertical exercise apparatus have no ergonomic adjustability, and the range between low and high intensity exercise potential is also limited. The support surfaces and handles are not shaped correctly for the human body and cannot be utilized for long periods of time without pain or injury to the practitioner. Over time the joint and connective tissue strain experienced on typical apparatus forces the practitioner to discontinue use of the apparatus due to pain or injury caused by the incorrect joint positions or compression points the practitioner is forced to endure.

The foregoing example of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tool and methods that are meant to be exemplary and illustrative, not limiting in scope. In various embodiments, one or more of the above-described problems have been reduced or eliminated, while other embodiments are directed to other improvements.

The disclosed vertical exercise device, hereinafter referred to as the "device," and method produces the central nervous system response at a higher level safely, as well as reduces joint, myofascial and tensional line pain and impingement experienced on current vertical exercise apparatus. The disclosed device permits the practitioner to exercise safer for longer periods of time and for a larger range of ages from toddlers to the elderly, without the practitioner being required to discontinue the use of the device.

The disclosed device produces more even tensions through the musculoskeletal system while reducing or eliminating joint pain with a more natural positioning, angle and shape of handles and supports. It can accommodate a large range of varying heights and widths of practitioners' body shapes, capabilities, age and levels of physical conditioning.

The disclosed device has handles that have multiple angles to match the natural, neutral and ergonomic position of the wrist when it is required to pronate or supinate while gripping and holding on to the device during particular exercises. The angle and height location of the handles in relationship to the foot supports during properly executed exercises also keep the wrists from extending or hyperextending to the side too far as to create joint impingement and restrict blood flow and neurotransmission through the joint and its surrounding tissues. The device can have a set of handles located specifically to accommodate a small range of practitioners' varying heights, or an array of handles used to accommodate the majority of varying ranges of heights from person to person. The array of handles allow the device to universally fit the majority of people without having to change or adjust the device in any manner. The practitioners will use that handle and foot supports that best suits their height for an exercise.

The angle of the handle changes to match the natural angle and position of the hand and wrist as the arms are moved outward from the side of the body when the hands are below or above the shoulders during movement. The handle shape and positions relative to each other and the foot supports minimize the side to side articulation (pronation and supination) of the wrist from the beginning to the end of a proper vertical exercise or movement. This prevents abnormal strains on the wrist that will reduce the performance of the muscles in and from the hand and along myofascial and tensional lines going to the torso and feet, because the body is now required to focus energy on the defense of the wrist and reducing (governing) the level of permitted extension and contraction of the muscle within the lines as not to injure itself. This device allows the energy that was governed back to be spent in the muscles within the myofascial and tensional lines, and more contraction and extension is permitted with no threat to the wrist because the wrist is never forced to pronate or supinate too far to either side during the entire range of motion. Typical horizontally and vertically aligned handles over rotate (supinate and pronate) or hyperextend the wrist joint forcing it into a non-ergonomic position and alignment, and results in pain and injury.

This disclosed device has a set of handles that can rotate about a center axis in the front of the apparatus to different positions, or rotate freely while moving up and down and side to side freely for added intensity for the practitioner and to add to the variations of exercises that can be done on the device, or the handles can be fixed in position at any given location.

The handles can rotate about a side axis to turn over or mirror the angles of one handle bar to produce a second set of different angles and lock into place, or rotate freely to add intensity to the exercises.

The handles or array of handles can rotate around a vertical axis freely or adjusted to a fixed position so that the handle-line from hand to hand is no longer parallel to the foot-to-foot line or front face of the foot supports. The handles or array of handles can be fixed at a set height or move freely up and down while rotating freely about the vertical axis.

The handles or array of handles can be adjusted forward or backward on the base of the device changing the relationship between the hands and feet to change the dynamic forces experienced by the practitioner while doing vertical exercises. The handles can be move backwards and away from the practitioner to a point that will allow the practitioner to position their torso directly over their feet and eliminate the sympathetic response, as the practitioner can then balance on their feet without the use of their hands, therefore removing the threat of falling and allowing the practitioner to also do horizontal based exercises in the parasympathetic nervous system physiological state. This can be beneficial when introducing vertical exercise to a beginner or deconditioned person, and allow the person to condition and prepare themselves for the added backward and angular forces experienced when the handle is moved toward them, pushing their torso backwards and no longer directly above the feet pushing them into the sympathetic nervous system.

Handles can be rotated about both a front and side axis and fixed into any desired position, or left to rotate freely at one or both axes to increase the physical demands and intensity required of the practitioner.

Handles in any of the above configurations can be adjusted forward at a downward angle from the standing base of the device, changing its inline relationship to the foot supports below. This will force the practitioner to work harder to keep their feet forward on the foot supports, increasing the challenge and intensity when doing vertical exercises that require the feet to move upward onto the above foot supports.

For those people that want to inspire strength and/or muscle growth, it is optimal to use an open grip and not allow the thumb to wrap around the bar. This open grip is difficult to maintain when exercising as the person usually forgets about where their thumb is when the exercise intensity begins to increase as more and more repetitions of the movement progress. The thumb naturally finds the most comfortable and less demanding grip, and after a few reps the person finds their thumb is wrapped around the handle bar and the potential benefits are diminished. This device can be made to have a thumb control plate on one side of the handle that will not permit the thumb to wrap around the bar and close the grip, forcing only the fingers to be the gripping points of the device, thereby maintaining the tension from fingers to core regardless of the person's level of intensity or fatigue. If the thumb is allowed to wrap around the handle bar, the grip tension is focused in the forearm flexor group of muscle and does not transfer through the tensional line of muscle leading to the torso. The plate making up the thumb control can be made in such a manner that it can adjust and change the depth and distance the fingers can wrap around the bar and force more tension into the fingers as the gripping contact surface of the fingers is pushed out farther toward the tips of the fingers. This plate controls the amount of depth around the handle bar that the fingers can wrap around the bar. The farther around the fingers can wrap around the bar, the less tension from fingertip to torso/core is required to hang on during exercise. To intensify the level of tension to the core and inspire more strength and/or growth in the muscle along this tensional line, the thumb guard can be moved around the radius of the handle bar limiting the distance the fingers can wrap around the handle.

The height relationship of the foot supports to each other are fixed or adjustable. When fixed they are spaced above and below each other at a distance that will allow any and all vertical exercises requiring the lifting and lowering of the feet into differing positions during an exercise to have sufficient distance to allow the foot to lift and move out and away from the edge of the above or below foot support and not impact it. If the foot holds are spaced too close to each other in height, the toe can impact or get caught on the above foot support as the foot moves to step onto it. If the foot supports are too close in height to the one below it, the foot stepping down onto it may not have enough space and time to be brought inward far enough to establish a good footing before the body's weight is rested upon it.

The position and angle of the foot supports in relation to the handles above can be adjusted forward and back and angled as well to change the inline relationship, and the dynamics forces that can be changed to decrease or increase the intensity of exercises.

Either the handles, the foot supports or both can be mounted to a structure wall or a vertical post or column. A single handle and a single foot support can be attached to a wall or column creating a specific and limited vertical exercise device, or additional handles, foot supports or both can be attached creating more versatility and removing limitations. In some embodiments, such as where a vertical post or column is used, the lateral ends of the one or more handles may freely extend into space and are not anchored to a static structure.

The length of the foot support is at a length that will accommodate the various different body widths, heights and natural foot and ankle positions from person to person.

The depth of the step is made in such a manner that it supports varying lengths and sizes to give all enough distance to place the entire ball pad of the foot into the step, so everyone can enjoy an equally stable footing on the apparatus and be able to focus on the exercise, not the lack of foot support. This depth of the foot support can be a fixed dimension to accommodate everyone, or it can be made adjustable to limit how far the person's foot is allowed to go into the foot support for performance and rehabilitation purposes by the location of the vertical surface located to the back of the foot support surface acting as a toe stop.

A fixed or adjustable vertical back surface of the foot support foot or toe stop surface not only limits the distance the foot can go into the foot support, it also prevents injury if the foot slips and moves forward undesirably. When doing vertical exercises, the practitioner's body is often leaning back and away from the device with the practitioner's feet forward and out from under the torso, which applies a forward force to the feet like they are sliding out from under the practitioner, hence part of the physical threat confirmed by the inner ear and combined muscle contractions. If the foot is allowed to move too far into the foot support, the practitioner's shins can impact the front edge of the foot support, and may continue to slip forward until the entire foot has gone in and past the foot support surface, and the practitioner then made to fall down and off the device causing serious injury or death. The toe stop, whether fixed or adjustable, prevents this potential accident from happening and the potential of the practitioner's foot and/or leg from being captured and pinned in the apparatus. Current apparatus resembling a ladder are most dangerous and have a constant potential for injury or death, as there is nothing to stop the foot from moving too far in and past the foot rung. Open back steps are equally as dangerous with nothing to limit and stop the entry of the foot.

The height and distance of the foot supports can be adjusted to fit within a person's limited range of upward leg motion due to limited flexibility and/or strength from lack of conditioning or a past injury. Adjusting the height of the foot supports will allow the limited practitioner to do the exercise in its entirety and receive as much of the benefits possible, but they will not be forced to get hurt going beyond their safe range of motion and hurt themselves more, or not be able to do the exercise at all.

The angle of the foot supports is critical, as are the angles of the handles. The foot supports are at an angle that the practitioner's entire surface of the ball pad of the foot will rest on the top surface of the foot support. The support surface of the foot supports may be substantially flat. The angle of inclination of the foot support should be greater than 0 degrees and less than 35 degrees for normal use and intensities, and between 35 degrees to 85 degrees for exercises requiring more upper body muscle recruitment and intensity than the lower body. In some embodiments, the angle may be approximately 20 degrees. It should be appreciated that in certain embodiments, the plane of the foot support(s) may be tilted or pivoted relative to the vertical axis of the device if desired for a given exercise or user; in this way, the angle of inclination of each foot support surface may be further adjusted with respect to the user, without necessarily adjusting the angle of inclination of each foot support surface with respect to the mounting plane of the foot support(s). With the entire bottom surface of the foot's ball pad in contact with the top surface of the foot support, the foot will not experience localized pressure on, or along, any of the articulating bones of the foot, and not create localized pressure on the bottom tissues of the foot which can cause injury to both the tissue and bones immediately if exercises are done improperly or over time regardless to how an exercise is done. If the top surface of the foot support is horizontal, the foot will be supported by only the edge of the foot support which focuses a line of pressure across the ball pad of the foot creating all the damage and injury aforementioned, and the same results from the rung of a ladder, and all resulting in limited physical performance of the practitioner and limited sustainability of the exercise modality.

The angled top surface of the foot support also provides a platform of resistance against the forward forces on the feet, produces more surface contact pressure between the ball pad of the foot and the top surface of the foot support, therefore increasing the friction and neutralizing the forward forces, and converts the forward forces into traction greatly reducing the potential for the foot to slip forward. This is similar to an embanked corner of a racetrack that transfers the car's inertia when the car is going around a corner at a high rate of speed into the ground giving all the wheels of the car more traction. The angled ground or supporting surface under the wheels of the car drives the inertia downward into all four wheels and into the ground, rather than letting the inertia parallel the ground and all the weight of the car going into one or two of the wheels causing the car to slide or roll over sideways. Angles greater than 0 and less than 35 degrees maximize the surface contact and neutralize forward forces in relationship to the user's up and down position of the torso; as the lower the body becomes closer to the feet, the angled position of the foot and forward forces will change and therefore require a different angle to maintain the ideal balance of surface contact and forward forces. Angles greater than 35 degrees will further decrease the potential of forward movement of the foot while also decreasing the leg's ability to hold the torso in the proper exercise position, which will increase the intensity and muscle recruitment of the upper body. A 90 degree angle will eliminate the lower body's ability to contribute to holding the torso up in proper position, but will maintain the angle and position of the torso relative to the feet maintaining the physical threat. If the torso is positioned higher and away from the feet, using the greater angle (that was ideal for the lower torso position) will then force the foot to lift off the ball of the foot and place all the support pressure onto the toes.

Foot supports can be made to split in half and accommodate separately the right and left foot. Individually the right and left foot supports can be adjusted at different heights from one another to create a non-symmetrical line of tension through the body for unique exercise and rehabilitation effects.

The foot support is made with rounded ends to prevent pain or injury to the inside of the practitioner's legs when doing vertical exercises requiring the torso to remain close to the device while moving up and down in motion forcing the legs to spread open, rest and slide on the front edge of the step. Square cornered edges and ends would focus pressure on the tissues of the inner leg causing pain or injury, forcing the practitioner to limit the amount of exercise repetitions or modify the exercises form improperly and can cause other related pain and injuries.

The device according to the present disclosure may also include controls to automatically adjust the handles and foot supports, and the angles and distances between them. The controls may also be programmed to monitor physical intensity and make automatic adjustments to maintain a more constant intensity required from the practitioner during the repetitions of the exercise or changing exercises. It should be appreciated that the positional adjustment of components according to the present disclosure is not limited to spatial arrangement in the vertical plane or the tilting of a single plane; the horizontal and vertical positioning may be independently adjusted for each foot support and/or handle component. In certain embodiments, handles of a handle array/assembly are independently adjustable, while in others, the handles are adjusted together in one or more dimensions relative to the foot support(s).

The device according to the present disclosure may also include a horizontal vibration system that moves the handles and/or foot supports forward and backwards, side-to-side and/or through a looped pathway (e.g., circular motion). Typical vibration applications for exercise apparatus are vertical in direction moving the person up and down. Vertical vibration (up and down motion) can stimulate a central nervous system response as the floor is dropped underneath the person and then pushed back up causing the body to adapt to the moving surface, but the adaptation is very quick and equilibrium is not actually threatened with the feet still directly under the torso. Vertical vibration is an adaptable change in elevation and frequency to the position of the horizontal support surface, and over time the body will stop reacting to it as a threat.

This innovative vertical exercise device may have horizontal (forward to back or side to side) movement or vibration. The horizontal movement or vibration pulls the feet or hands out from under or away from the practitioner, and/or side to side, in a horizontal direction that does threaten the CNS in an abnormal way and continues to threaten it until it terminates. The body cannot recognize it as an adaptable change in anchor position and frequency of the horizontal support surface, and will consistently switch into the sympathetic nervous system.

Using a horizontal vibration on this device increases the level of muscle recruitment during all exercises. For instance, the greater the forward and backward distance of motion, the more increase of muscle recruitment already recruited for the exercise and it causes the recruitment of additional muscles not otherwise needed for the exercise.

The use of vertical vibration done with typical fitness vibration apparatus is dangerous and if the person using the vertical vibration locks the knee or elbow joint supporting them on the surface, the vibration forces will transfer up and into the head and can cause the brain to separate from the skull. The horizontal vibration used in the present disclosure will not cause a threat of injury to the practitioner regardless of any joints being locked and rigid.

All the above configurations of the present disclosure can be done with a built in man-lift or hoist that will assist the user or therapist when getting onto the device. It can have a shock absorbing safety lanyard that can remain attached to the safety harness worn by the user to insure the safety of the user if they become fatigued or incapable of holding on to the device. This makes it safer for the therapist or assistant as well as the user if the potential of failure is there, and will keep the user upright and not allow the user to fall and impact the floor.

In addition to the exemplary aspects and embodiments described above, further aspects and embodiments will become apparent by reference to the accompanying drawings forming a part of this specification wherein like reference characters designate corresponding parts in the several views.

BRIEF DESCRIPTION OF THE DRAWINGS

The present disclosure is further described below in reference to the accompanying figures.

Before explaining the disclosed embodiment of the present invention in detail, it is to be understood that the invention is not limited in its application to the details of the particular arrangements shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

As used herein, the terms top and bottom, upper and lower, etc. are relative to the vertical direction, axis and/or plane. The term front corresponds to the side of the device facing a user during exercise; the term back corresponds to the side of the device opposite the front. The terms back and forth, forward and back, front to back, etc. are relative to the front and back of the device and correspond to the horizontal direction, axis and/or plane. Terms like side-to-side, lateral, etc. indicate a horizontally perpendicular axis/direction relative to the back and forth, front to back, forward to rear, etc.

axis/direction. It is understood that these terms are used for convenience to describe a default configuration of the device and positional/directional aspects of components and attributes thereto; components described in these terms—particularly the handle assembly, handlebars, and handles—may be also be rotatable about one or more axes as discussed below thereby changing the relative orientation to the default configuration, but it is not intended that such changes in orientation affect the accuracy of the terms in initially describing the structure. The vertical axis of the device corresponds to the central vertical axis of its support structure (e.g., wall, post, column, etc.).

Figure 1:
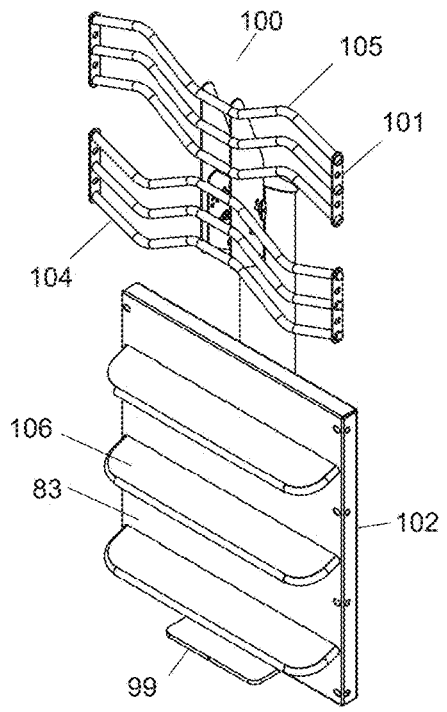
FIG. 1 is a front diagonal view of the device with a six-handle array and three-foot support array attached to a vertical support post.

FIG. 1 is a diagonal view of a device according to the present disclosure which is used to do vertical exercise and rehabilitation long term without adverse effects or damage to the joints, tissues and bones of the person performing the vertical movements and exercises. FIG. 1 shows the vertical exercise device 100 configured with an array of six handles 101 and an array of three foot supports 102 designed and configured to minimize joint strain and surface contact damage to tissues of the bottom of the feet, and to accommodate all varying sizes, heights and widths of different people. The device shown is made in such a manner that it can be anchored to a horizontal surface at the bottom of the device's foundation and mounting plate 99, and has a structural upright center post 103 to which the handle array 101 and foot support array 102 can be attached and configured independently of each other.

Figure 2:
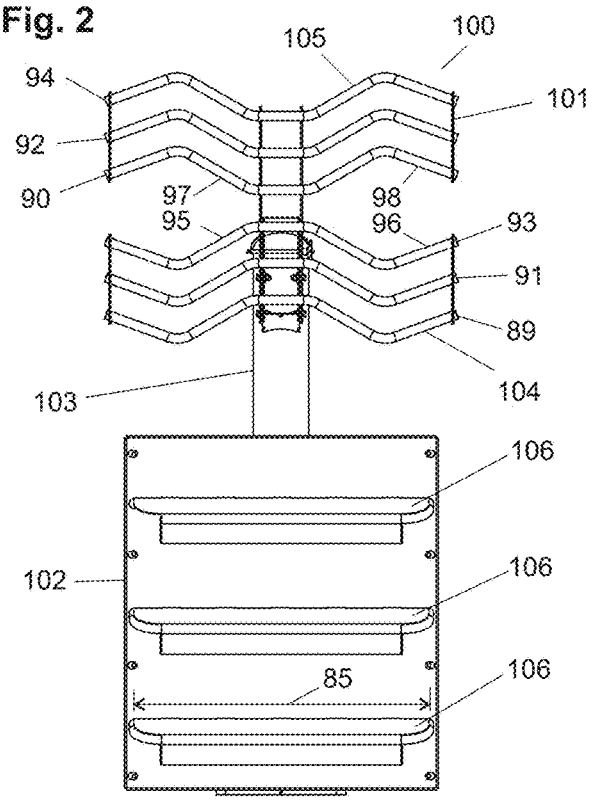
FIG. 2 is a front view of the device of FIG. 1.

FIG. 2 is a front view of the device 100 showing the right and left symmetrical form and angles of the upper 105 and lower 104 handles, and the arrangement or array 101 of multiple handles spaced apart from each other in such a manner as to maintain the same hand and foot placement on the device relative to a person's height and width, while also maintaining an equal and safe position and range of motion of wrist, joints and feet. The form and angles of the upper and lower handles allow persons with narrow shoulders to grip the device handle 95 closer to the end of the handle length that is closer to the center of the device 100, while the person with wider shoulders can grip the handle 95 closer to the end of the handle length which is farthest from the center of the device 100, and anyone with shoulder widths in between can grip the relative position along the length of the handle 95 to suit their particular shoulder width. The same is also applicable to the other handle lengths of handles 96, 97, and 98 with respect to the exercise and movements that require the use of each of them.

It is also visible in FIG. 2, the width 85 of the foot support 106 will permit a person with narrow hips to position their feet apart from each other at a distance for the person's proper and safe range of motion for their hips, knees and ankles with respect to the particular exercise or movement the person is doing on the device 100. The width 85 is required to also equally accommodate the proper positioning of the feet for a person with wider hips doing vertical exercises and movements requiring the widest safe distance apart. The ideal dimension 85 is approximately 30 inches (about 76 cm), but can be less if the device 100 is produced specifically for one person relative to the width of their hips. The dimension 85 can be greater to produce additional room in case of inaccurate foot placement when doing exercises and movements requiring the feet to move on and off the foot support 106.

At the ends of the foot support 106 and the dimensions 85, the front outside corners of the foot support 106 may be round, so when doing exercises and movements requiring the legs to spread apart and the inside of the legs to make contact with the front edge of the foot support 106, practitioners' legs are able to freely press upon and slide along the ends of the foot support without discomfort or injury.

Figure 3:
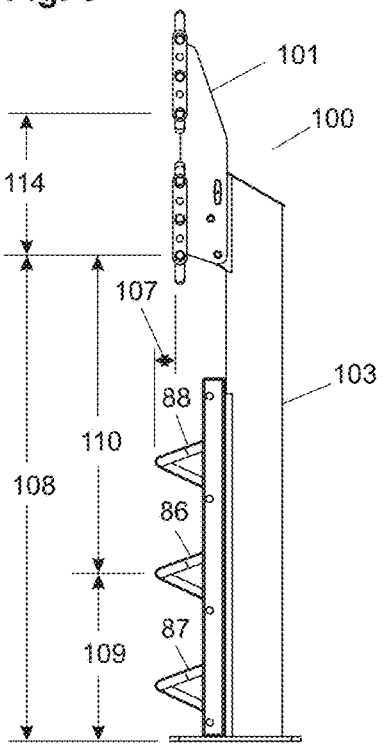
FIG. 3 is a side view of the device of FIG. 1.
Figure 4:
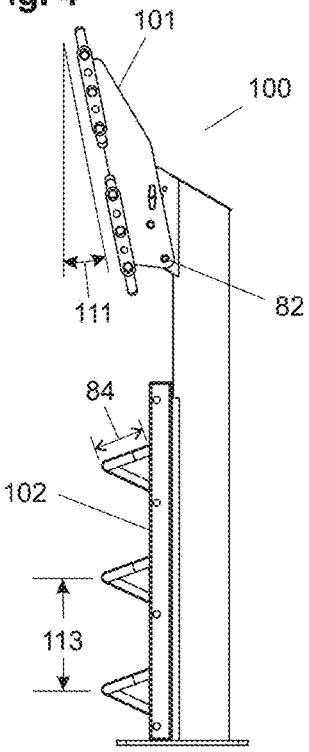
FIG. 4 shows the device of FIG. 3 with the six-handle array in a tilted forward 15 degrees position.
Figure 5:
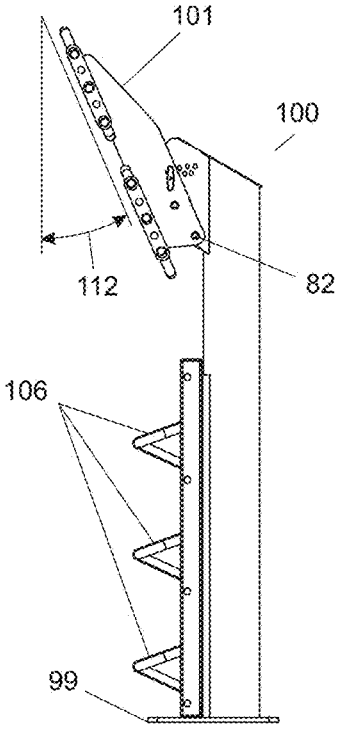
FIG. 5 shows the device of FIG. 3 with the six-handle array in a tilted forward 25 degrees position.

FIGS. 3, 4 and 5 are side views of the device 100. In FIG. 3, the dimension 110 is the ideal distance between the center foot support 86 and the handle bar 104. The handle bars 104 are used for a conditioned or fit person to do exercises or movements requiring the hands to be at shoulder height or lower. Dimension 114 is the additional distance from the foot support 86 to the upper handle bar 105. The upper handle bars 105 are used to do exercises or movements requiring the hands to be above the shoulders and head.

FIG. 3 shows the dimension 107 that is the offset distance from front to back of the front edge of the foot support 106 and an upper 105 or lower 104 handle bar required to force the person's torso or upper body in such a position over the feet that they cannot find or establish equilibrium, and therefore trigger an autonomic response and puts the person into the sympathetic nervous system. The offset dimension 107 can be increased to force the torso farther away from being over the feet to create more leverage forces and increase intensity. The dimension 107 can be decreased and even flipped to a negative distance allowing the torso to come directly over the feet and establish equilibrium, but the sympathetic response of the nervous system will not be triggered and the benefits thereof not enjoyed by the practitioner. This adjustment would be desirable for deconditioned beginners that need to control their progression of leverage and intensity to avoid overtraining or injury. The incremental adjustment, from a negative distance 107 with attainable equilibrium to a distance of no attainable equilibrium and beyond, gives the practitioner the ability to enjoy the benefits of both parasympathetic and sympathetic states with one device.

The depth 84 of the foot support 106 is required to control the depth and position of the foot when on the device 100, and to not permit the heel of the foot to rest on the foot support 106 contact surfaces. By not allowing the heel to rest on the surface of the foot support 106, there is additional tension forces created in the plantar fascia ligament that is then transferred through and along the tensional line of muscles from the toes to the torso, and then on through to the hands increasing the numbers of muscles recruited to perform exercise and movement on the device 100, thereby increasing the intensity and caloric expenditure per second burning more calories and fat in less time making it more efficient for conditioning and weigh loss. The vertical surface 83 acts as a toe stop for the foot position that regulates the depth the foot can go onto the foot support 106, and also prevents the foot from going too far into the foot support that it would go past and off the foot support 106 top contact surface, which could cause the person to lose their balance and hold on the device and get seriously injured breaking their leg or more if they fall completely off the device while their leg is too far in the device 100 between the array of foot supports 102. The depth 84 is the dimension required to accommodate small people with short feet and large people with long feet given a foot support 106 surface that accommodates all people equally and safely. If the depth 84 is too great, the shorter foot will go too far into the foot support 106 and allow the person to rest their heel on the foot support 106, and not require and produce the same level of tension in the plantar fascia and continue through the tensional line to the hand, and therefore diminish or negate many of the specific exercise and movement benefits. If the depth 84 is too little, a taller person with longer feet would not be able to get their foot far enough into the foot support 106 to make surface contact with the entire ball or front foot pad of their foot and have only their toes contacting the surface of the foot support 106, thereby creating too much tension and force in the carpals and ligaments of the foot that cannot be sustained long enough to get the targeted and ideal benefits of the specific exercise and movements. The ideal maximum depth or dimension 84 is approximately 5.25 inches (about 13.3 cm), but can be specifically less or more if the device 100 is produced for one specific person or adjusted as described herein.

The dimension 109 is the distance from the foot support 86 and the floor or ground relative to the distance 108 from the floor to the first lower handle bar 89. The distance 108 is required to create enough distance 109 to accommodate a second foot support 87 below the foot support 86 at the dimension 113 to be used for people of less conditioning or lower levels of fitness. By having a person hold on to any of the handle bars 89-94 and use foot support 87, the torso is moved closer to the front of the device 100 than it would be if on the foot support 86 above it where the torso would be pushed farther away from the device 100 where the leverage forces and weight of the torso are greater. It is easier to do exercises and movements on the lower foot support 87 than on the higher foot support 86. With that being said, for the more fit and conditioned person, using the highest foot support 88 would increase the leverage weight and force created by the torso more than would using the foot support 86, and will therefore produce a higher level of intensity and required strength for all exercises and movements done on the foot support 88. Therefore, the configuration of the device 100 efficiently accommodates all the needs of people from extremely unfit or deconditioned to people that are extremely fit and conditioned just by using the ideal foot support for their specific level of conditioning or fitness, and allows them to progress from one extreme to the other all on the same device 100 without any physical adjustments to the device 100 itself.

In FIG. 4 the dimension 113 between the lowest foot support 87 and the foot support 86 above it is at an ideal distance that when doing specific exercises or movements on the device 100 that require the foot to move up and down to the foot supports above and below it, the person's foot will have enough distance for the foot to come out the required distance to clear the front edge of the foot support above or below it without it hitting or getting caught and stopped during the exercise or movement. The distance 113 required between foot supports for safe and proper execution of the specific exercises and movements is approximately 12 inches (about 30.5 cm).

The distance 113 can be adjusted to less or greater than ideal to create an abnormal challenge causing more focus and attention on where the feet are moved and then placed. The distance 113 can be different for the foot support 87 below the foot support 86 than the distance between foot support 86 and foot support 88.

FIG. 4 shows the device 100 with a handle array 101 that can pivot at a point 82 where the handle array 101 is attached to the vertical post 103 at an angle 111 toward the person using it and away from vertical. The handle array can pivot independent of the foot supports thereby changing the normal linear plane relationship of the hands and feet and making them angled to each other, which in turn force's the torso farther away from over the feet 119 vertically and increases leverage forces, and thereby exercise and movement intensity. In certain embodiments, the plane of the handlebar assembly could be tilted as much as 85 or 90 degrees relative to the vertical axis of the device for extreme back tensional line recruitment. Likewise, the plane of the foot support(s) may also be tilted or pivoted relative to the vertical axis of the device if desired for a given exercise or user; in this way, the angle of inclination of each foot support surface may be further adjusted with respect to the user, without necessarily adjusting the angle of inclination of each foot support surface with respect to the mounting plane of the foot support(s).

FIG. 5 shows the handle array 101 tilted at a greater angle 112 further increasing leverage forces and intensity. The angle of tilt can be more than or anywhere in between the angles 111 and 112 to finely adjust to the desire level of force and intensity for the user.

Figure 6:
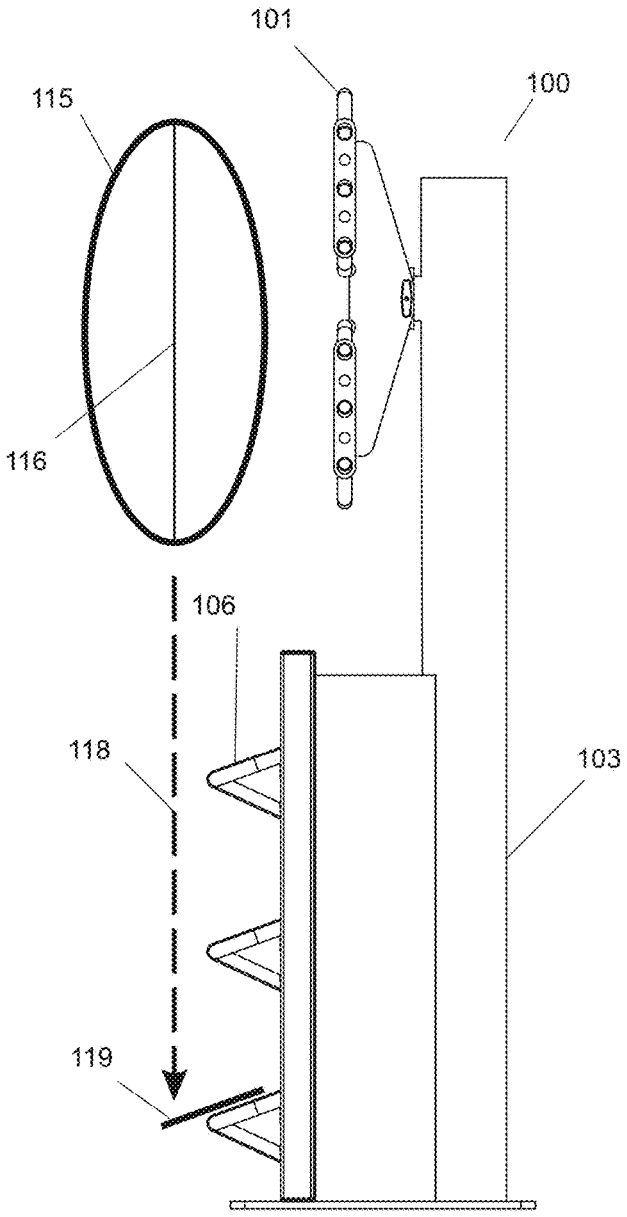
FIG. 6 is a side view of the device illustrating the position of a torso directly over the feet with the foot support array moved forward in front of the handle array.

FIG. 6 shows the device 100 with the foot support array 102 position at a negative dimension 107 that moves the handle array 101 forward enough that the center line of gravity 116 of the person's torso 115 can be positioned in a line 118 directly over their feet 119 and establish equilibrium without the need for any anchoring of the hands to the device, and therefore remain in the parasympathetic nervous system while exercising or moving.

Figure 7:
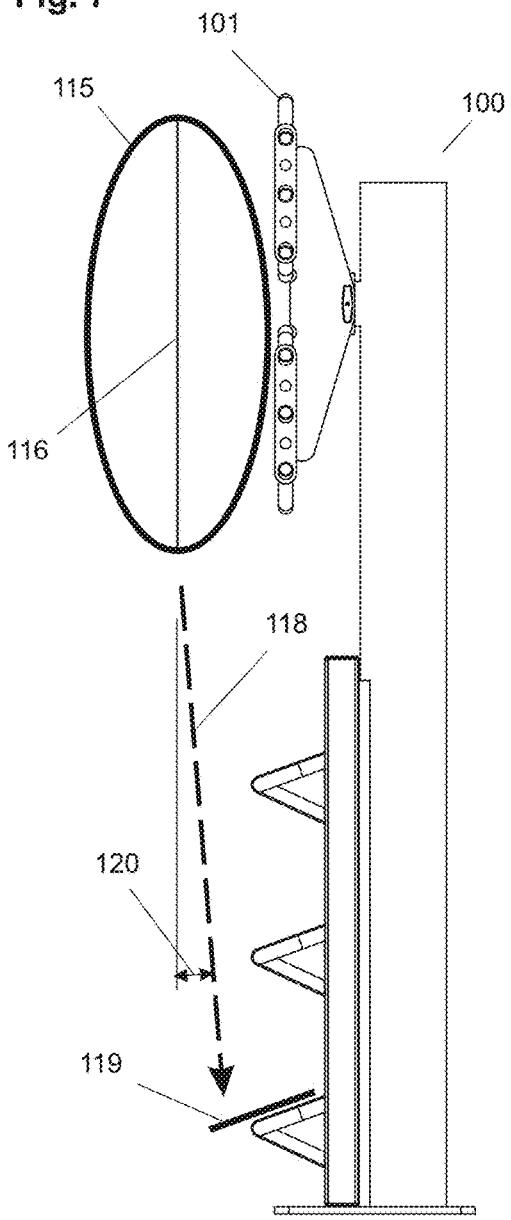
FIG. 7 is a side view of the device illustrating the position of a torso off center from over the feet with the foot support array moved back behind the handle array.

FIG. 7 shows the device 100 with the handle array 101 positioned at a positive dimension 107 that forces the line of gravity 118 of the torso off vertical at an angle 120 that will not permit the torso's 115 center line of gravity to be positioned directly over the feet 119 and establish equilibrium, therefor forcing the person to shift into the sympathetic nervous system in an autonomic response to the confirmed threat of falling.

Figure 8:
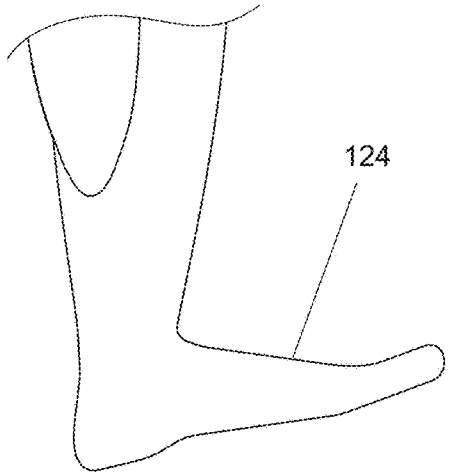
FIG. 8 is side view of a foot.

FIG. 8 is a profile view of a foot 124.

Figure 9:
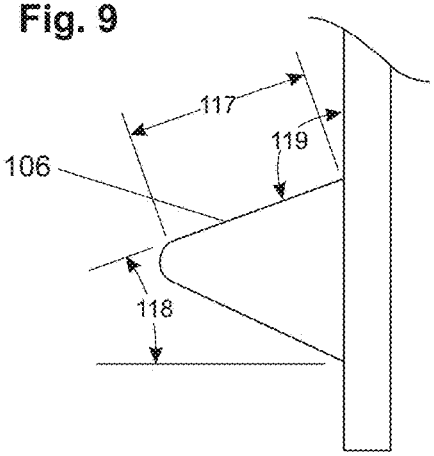
FIG. 9 is a side view of one of the device's foot supports with dimensions.
Figure 10:
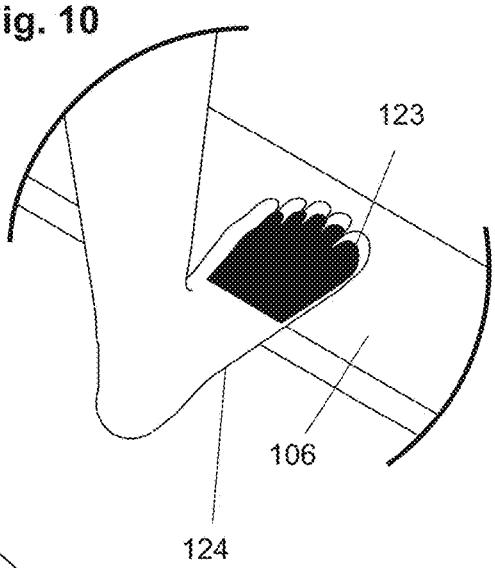
FIG. 10 is a front diagonal view of a foot on the foot support of the device illustrating surface contact.
Figure 11:
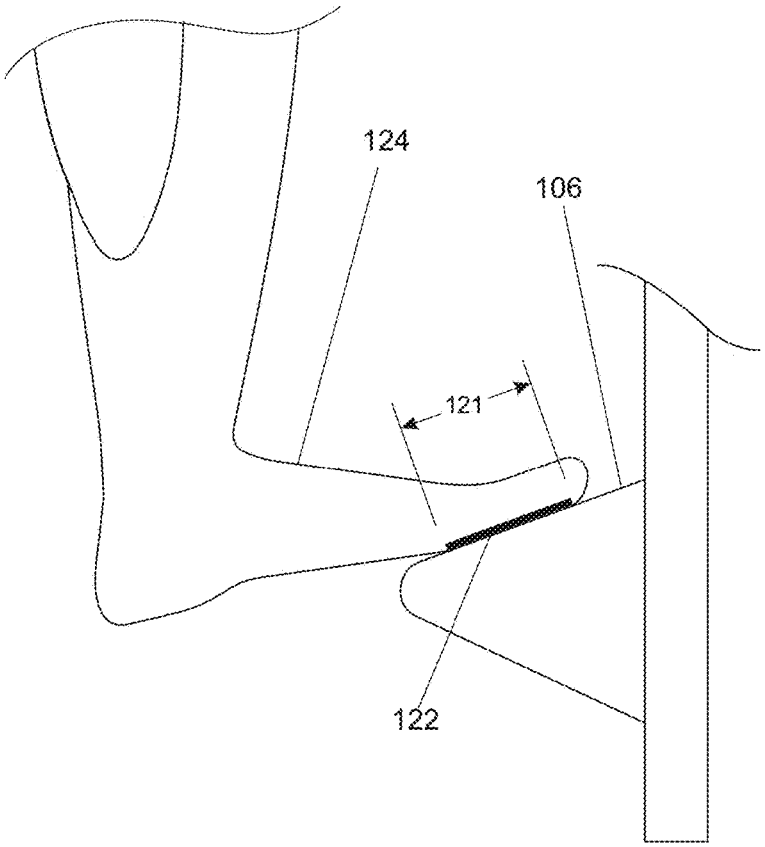
FIG. 11 is side view of a foot on the foot support illustrating the depth of surface contact.

FIG. 9 is a side view of a foot support 106 on the device 100. The ideal dimension 117 of the interface and contact surface of the foot support 106 is approximately 5.25 inches (about 13.3 cm). FIG. 9 shows the angle 118 from horizontal and the angle 119 from vertical that the contact surface of foot support 106 requires to permit the flat surface of the front pad of the foot 124 to interface with the contact surface of the foot support 106 and create a large area of surface contact 123 as seen in FIG. 10, therefore dispersing the weight of the person and gravitational forces over the maximum length and width of surface area 121 as seen in FIG. 11, rather than a small line of surface contact as experienced in all other types of foot supports used on ladders, steps and current vertical exercise apparatus. In all cases the surface contact will always be the entire width of the foot 124 interfacing with the front edge of the foot support. Unlike all other foot supports, in FIG. 11 this device 100 incorporates the required angle to take the line of interface normally experienced and spread it out into a long area 122 of surface contact on the foot support 106.

Figure 12:
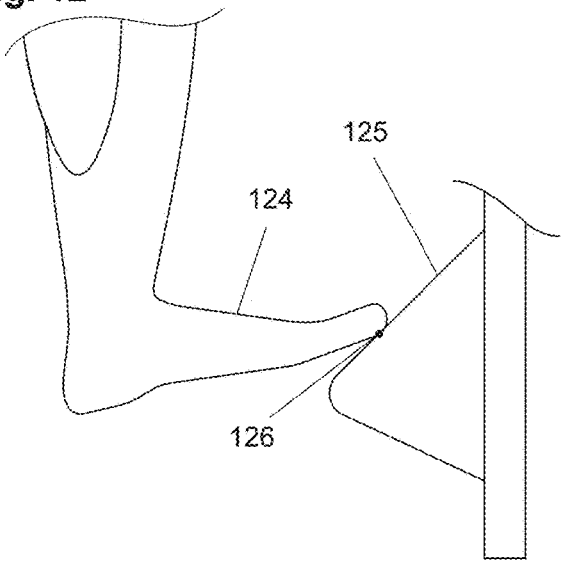
FIG. 12 is a side view of a foot on a foot support that is too steep an angle, showing the point of contact is at the end of the toes and has a lack of depth of any contact surface area.

FIG. 12 illustrates a line of surface contact 126 that is made between the foot 124 and a foot support 125 if the angle of the foot support surface 125 is too steep or great. An angle that is too steep for a higher torso position will force all the weight and forces created during exercise to focus on an edge across the toes at the contact point 126. The toes will be forced to contort and bend is a very strenuous manner that will be extremely uncomfortable for the user and produce too high a level of forces for the user to maintain for any short period of time forcing the user to stop exercising before attaining any of the potential benefits.

Figure 13:
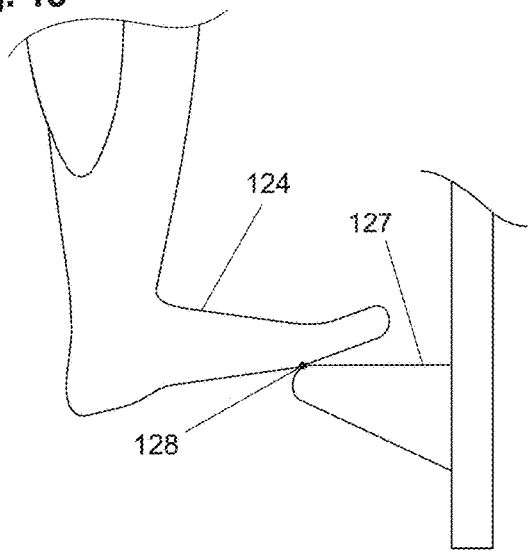
FIG. 13 is a side view of a foot on a foot support that has a flat horizontal top surface and the user's foot interfacing on the front of edge of the foot support, showing the point of contact is across the ball of the foot and has a lack of depth of any contact surface area.

FIG. 13 illustrates the point and line of contact 128 experienced when the foot support surface 127 is horizontal as found in current vertical exercise apparatus prior art.

Figure 14:
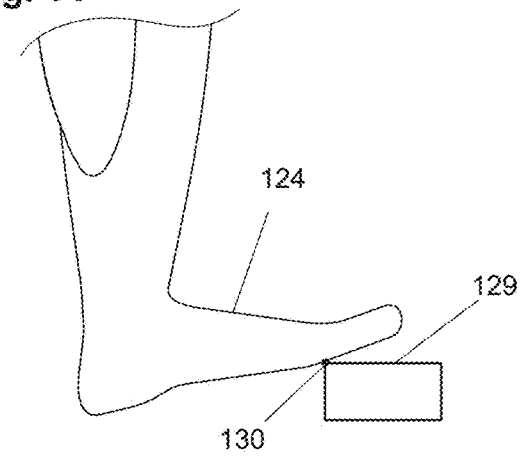
FIG. 14 is a side view of a foot on a square edge foot support that has a flat horizontal top surface like a ladder rung and the user's foot interfacing on the front of edge of the foot support, showing the point of contact is across the ball of the foot and has a lack of depth of any contact surface area.

FIG. 14 shows the point of contact 130 experienced on a square or rectangular shape foot support 129 found on most ladders regardless to where the foot 124 is placed on the edge of the foot support 124.

Figure 15:
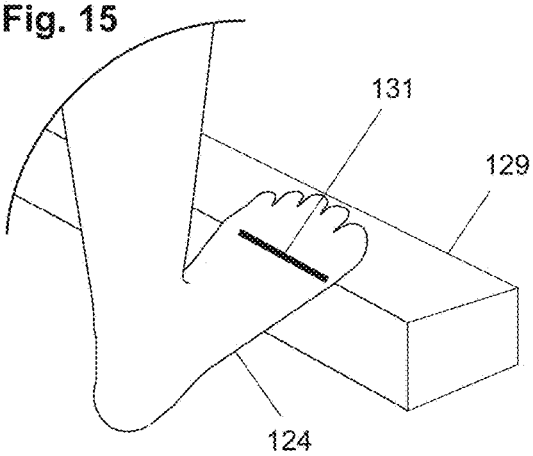
FIG. 15 is a front diagonal view of a foot on a square edge foot support that has a flat horizontal top surface like a ladder rung and the user's foot interfacing on the front of edge of the foot support, showing the point of contact is across the ball of the foot and has a lack of depth of any contact surface area.

FIG. 15 illustrates the small line of surface contact 131 produced when the foot 124 interfaces with the edge of the ladder foot support 129. With the foot 124 contact point where it is illustrated, the carpals of the foot will be forced to contort and bend around the edge of the foot support 129, thereby producing pain and discomfort and over time injury and damage to the foot 124 forcing the practitioner to stop doing vertical exercise and not experience its potential benefits.

Figure 16:
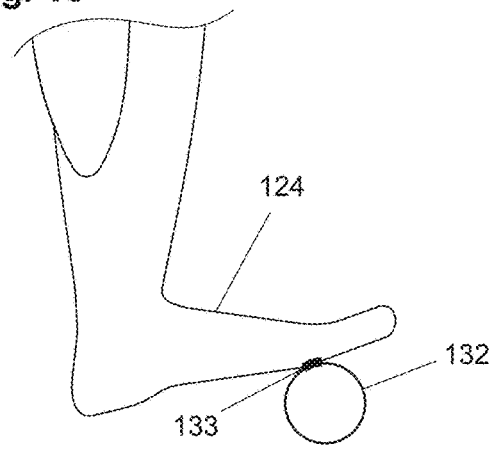
FIG. 16 is a side view of a foot on a round foot support like a ladder rung and the user's foot interfacing on the foot support, showing the point of contact is across the ball of the foot and has little depth of any contact surface area.

FIG. 16 illustrates the surface contact point 133 of the foot 124 when interfacing with a round foot support surface 132 that can be found on other types of ladders and vertical exercise apparatus.

Figure 17:
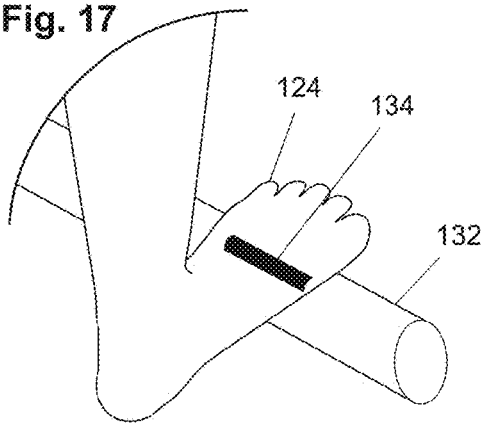
FIG. 17 is a front diagonal view of a foot on a round foot support like a ladder rung and the user's foot interfacing on the foot support, showing the point of contact is across the ball of the foot and has little depth of any contact surface area. The view shows the width of the contact surface area.

FIG. 17 shows that there is a little wide line of surface contact 134 on the round foot support 132 compared to the square or rectangular type foot support 129. The area of the contact surface area 134 on the round foot support 132 is not enough to create any less negative effects than those that are created with the edge of the square or rectangular foot support 129.

Figure 18:
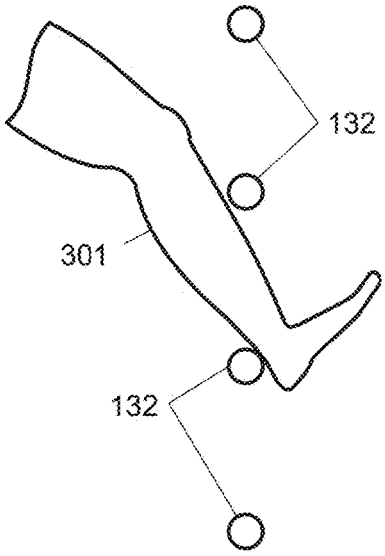
FIG. 18 is a side view of a person's leg and foot when there is nothing to limit or stop the foot from going into the round supports too far as a result of the lack of contact and drag resulting in the foot slipping forward.

FIG. 18 is a side sectional view illustrating the position of the foot 124 and leg 301 of the user if there is no toe stop surface 83 to stop the foot from going too far onto the round 132 or rectangular 129 foot support, thereby creating potential for injury and discontinuation of the exercise session.

Figure 19:
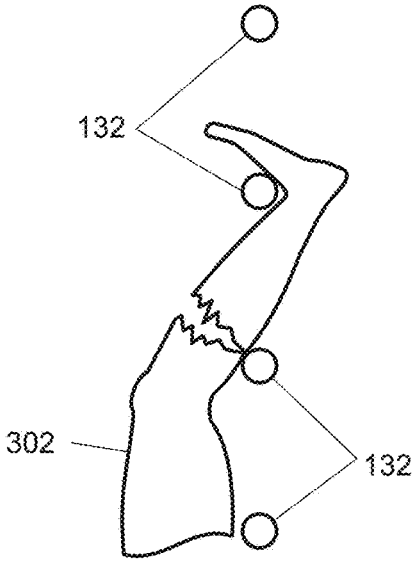
FIG. 19 is a side view of a person's leg and foot when there is nothing to limit or stop the foot from going into the round supports too far as a result of the lack of contact and drag resulting in the foot slipping forward, and the user losing their grip on the handles and falling back and down resulting in serious injury such as a broken leg.

FIG. 19 is a side sectional view illustrating a person's leg 302 that is broken as a result of the user's foot slipping too far into and off the ladder style foot support 132, causing the user to lose their hand grip on a current ladder style apparatus and their body falls down below the level of the round foot supports 132.

Figure 20:
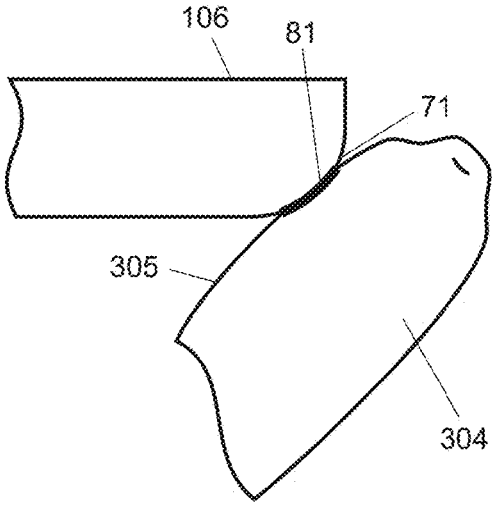
FIG. 20 is a top view of the comfortable surface contact of the device's rounded ends of a foot support and the inside of the user's leg when doing specific vertical exercises and movements.

FIG. 20 is a top view that illustrates the smooth surface contact area 81 between the inside 305 of the user's upper leg 304 and the outside rounded end 71 of the foot support 106 according to the present disclosure, which is rounded at a radius large enough not to irritate or injure the practitioner while doing vertical exercise or movements, and comfortable over long term use allowing for maximum sustainability for the use of vertical exercise and movement.

Figure 21:
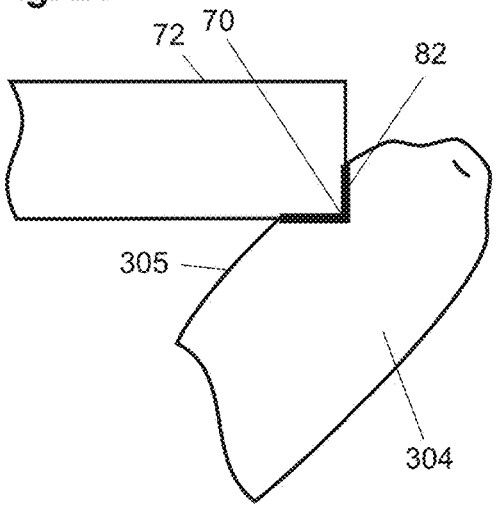
FIG. 21 is a top view of the sharp and painful surface contact of a foot support with right angled corners at the end of the foot support and the inside of the user's leg when doing specific vertical exercises and movements.

FIG. 21 illustrates the focus point of contact 82 of the person's leg interfacing with the square cornered end 70 of a foot support 72 causing pain and/or injury.

Figure 22:
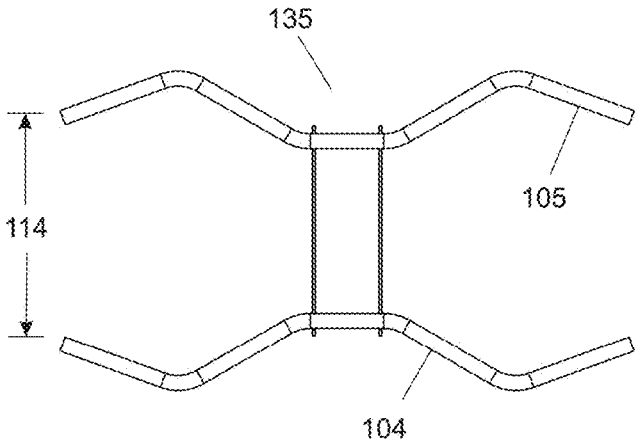
FIGS. 22 and 23 are front and diagonal views, respectively, of a two-handle array made from the combination of the device's lower and upper multi angled handlebars.

FIG. 22 is a front view of a two-handle array 135 that can be used to replace the handle array 101 on the device 100. It has only one each of the lower 104 and upper 105 handles, which are spaced the required dimension 114 apart from each other. This handle array 135 can be used for a specific range of people similar in height when set at a particular height above the edge of the foot support 86.

Figure 23:
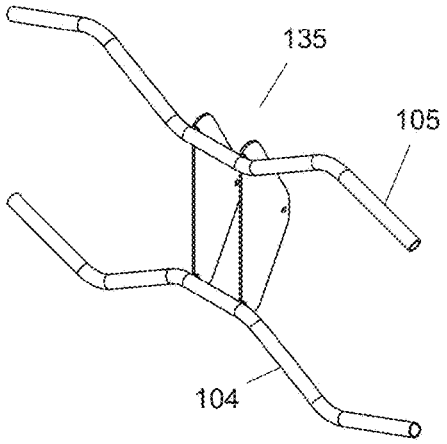

FIG. 23 is a diagonal view of the two-handle array 135 of FIG. 22.

Figure 24:
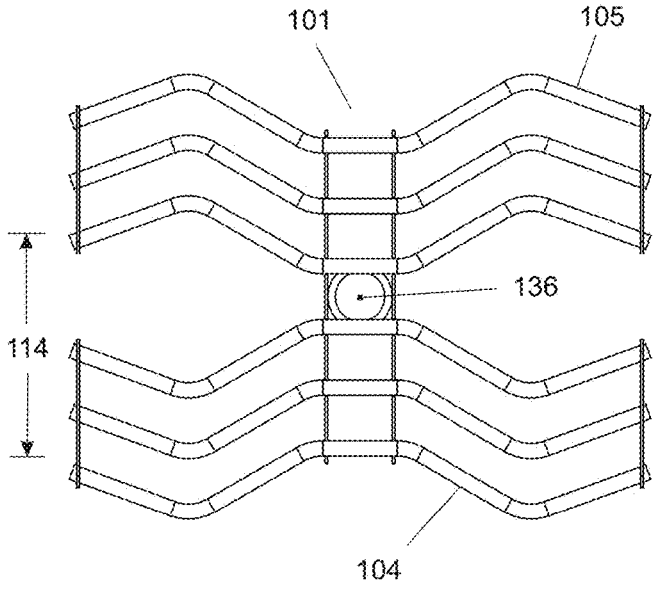
FIGS. 24 and 25 are front and diagonal views, respectively, of a six-handle array made from the combination of the device's lower and upper multi angled handlebars to accommodate different heights of users.

FIG. 24 is front view of a six-handle array 101 with a center horizontal rotational axis 136 from the front to the back.

Figure 25:
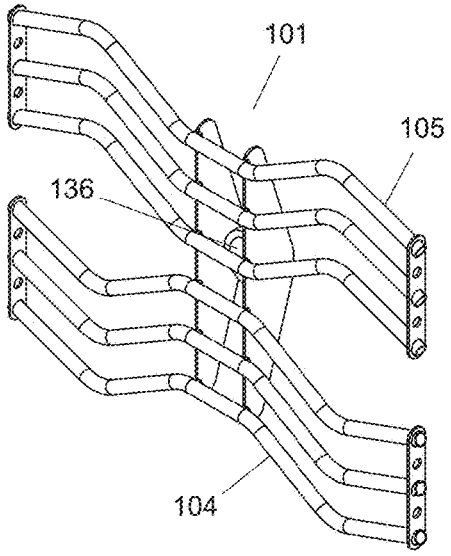

FIG. 25 is a diagonal view of the six-handle array 101 of FIG. 24 with the horizontal rotational axis 136 from front to back.

Figure 26:
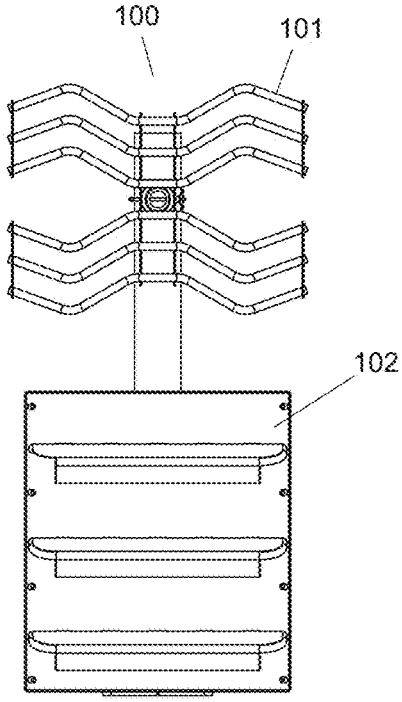
FIGS. 26, 27 and 28 are front views of the device with an adjustable six-handle array rotating about a front to back horizontal axis in a horizontal, 45 degree and 90 degree position, respectively.

FIG. 26 is a front view of the device 100 with the six-handle array 101 with the horizontal axis 136 attached to the vertical post 103 in such a manner that it can rotate in either direction freely or in adjustable increments and lock in a static position.

Figure 27:
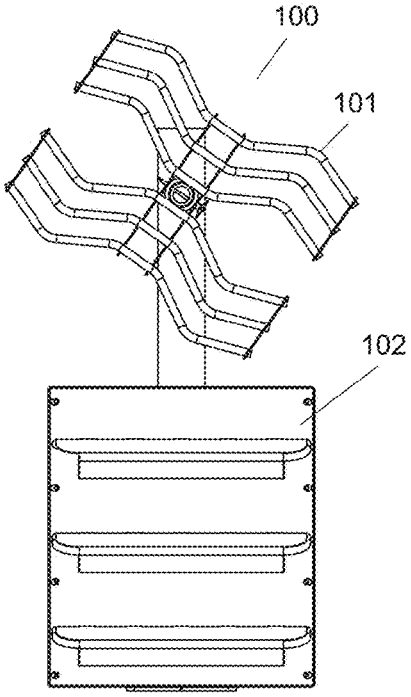

FIG. 27 illustrates the six-handle array 101 rotated about the horizontal axis 136 to a 45 degree position.

Figure 28:
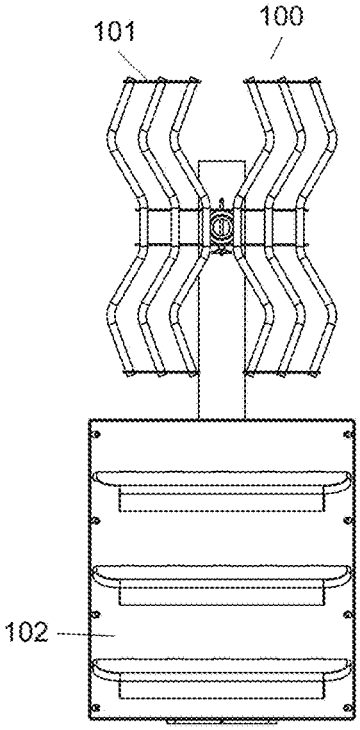

FIG. 28 illustrates the six-handle array 101 rotated to a 90 degree position. The handles 104 and 105 are allowed to rotate freely about the center axis 136. Thus, there is a much higher requirement for more muscle to be recruited in order for the practitioner to hold their position and form on the device, and even a higher demand in increased intensity when doing movements requiring a controlled torso position or direction. The six-handle array 101 will accommodate any height of user with no adjustment to the device 100 required.

Figure 29:
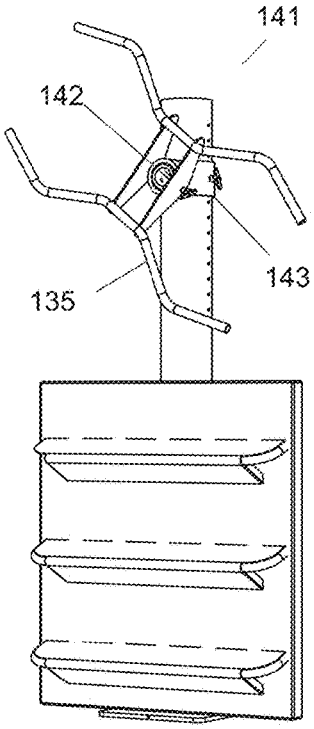
FIGS. 29, 30 and 31 are front diagonal views of the device with an adjustable two-handle array rotating about a front to back horizontal axis in a 45 degree, 90 degree and −45 degree position, respectively.
Figure 30:
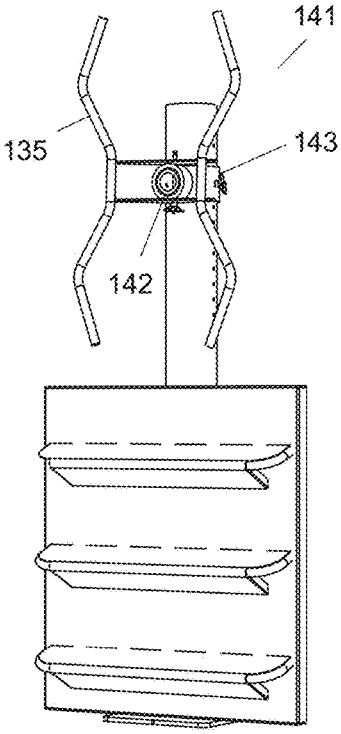
Figure 31:
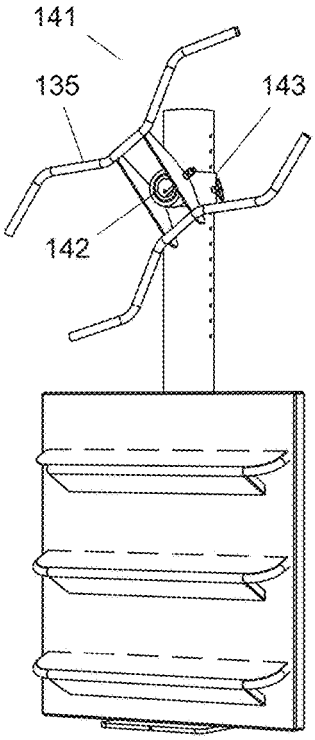

FIGS. 29, 30 and 31 illustrate the device 141 with the two-handle array 135 attached to the post 103 rotating about a horizontal axis 142 either freely or in adjustable increments the same as the above described six-handle array 101 with all the same benefits if set at a static height or distance from the foot support 86.

Figure 32:
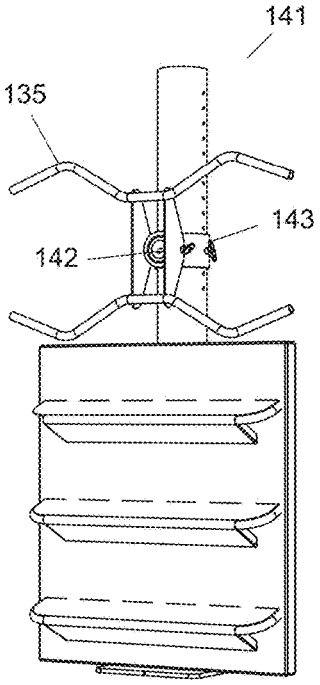
FIGS. 32, 33 and 34 are front diagonal views of the device with an adjustable two-handle array sliding up and down vertically in the lowest, middle and highest position, respectively.
Figure 33:
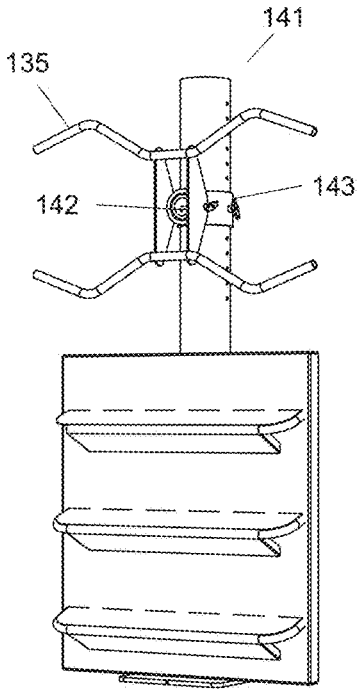
Figure 34:
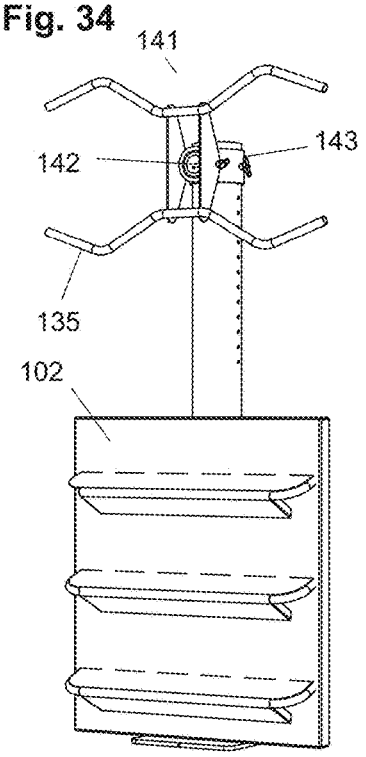

FIGS. 32, 33 and 34 illustrate the device 141 with the two-handle array attached to the post 103 in such a manner that the handle array 135 and the pivot assembly 139 at the horizontal axis 142 is then attached to an assembly 138 that can slide freely up and down vertically on the post 103, or be adjusted incrementally and lock in any static position vertically along the post 103, or vertical shaft or wall channel as the case may be for the specific embodiment. When the handle array 135 is allowed to slide freely vertically, it requires both the front and back tensional lines of muscles from hands to feet to be heavily recruited to control and hold the torso in the required position and form for the specific exercises or movements. This creates a very high level of strength throughout the tensional lines of muscles and consumes a large amount of calories per second.

When the handle array 136 is allowed to rotate freely about the horizontal axis 142 while also allowing the handle array 135 to slide freely up and down on the vertical post 103, the strength and intensity is amplified many times more again. The advantage to allowing either the free rotation or the vertical movement up and down of the handle array 106 is that the tremendous amount of caloric burn and strength required becomes very time efficient allowing the user to reach their exercise goals in much less time.

Figure 35:
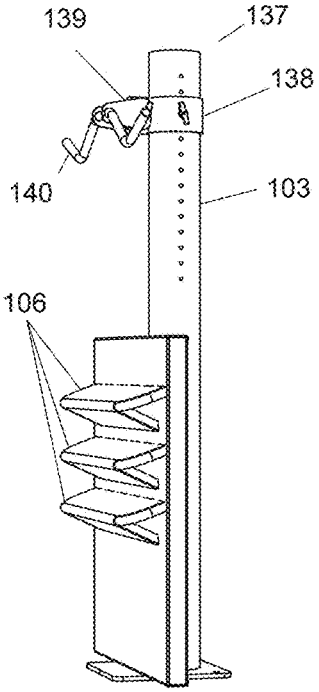
FIGS. 35, 36 and 37 are diagonal views of the device showing adjustable foot supports set at varying heights.
Figure 36:
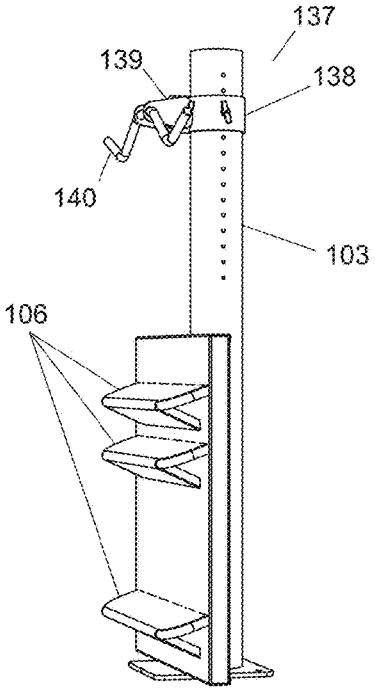

FIGS. 35 and 36 are diagonal views of the device 137 that has a single-handle 140 on a horizontal pivot assembly 139 attached to the vertical post 103 with a vertical slide assembly 138. The figures illustrate an adjustable array of foot supports 106 that can be set at different heights and distances from each other. The additional combination of the adjustable foot supports 106 up and down set at different distances from each other increases intensity and overall strength when doing any vertical exercises and movements. The varying distances require a greater level of coordination when doing exercises and movements that require the user to reposition their feet up and down during the exercise or movements. When the handle array 135 or any other configuration of handles are allowed to pivot or travel up and down freely, the user is forced to work against their own strength in addition to his own body weight.

Figure 37:
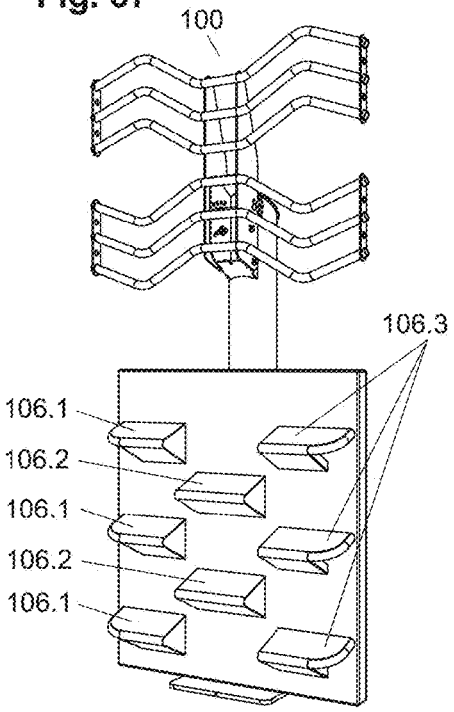

FIG. 37 shows the device 137 with an array of foot supports that are divided into sections; a right foot support section 106.1, a center foot support section 106.2, and a left foot support section 106.3 that can be set at varying heights or in a pattern. In such an embodiment, each foot support section 106.1, 106.2, 106.3 may be at least approximately five (5) inches (about 12.7 cm) wide to sufficiently accommodate the ball of a user's foot. The width may also be wider or narrower depending on the requirements of a particular user. The foot support sections may also be as few as two sections creating specific right and left foot supports, and/or more than three sections creating more than one center foot support or two or more right and left foot supports. Any combination of foot support section arrangement is also possible in moving from one level of foot support to another level.

Figure 38:
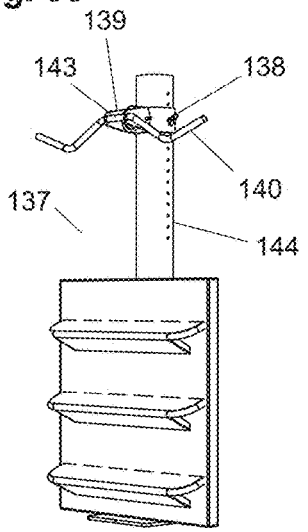
FIGS. 38, 39 and 40 are diagonal views of the device with a single swiveling handle that rotates about a side to side horizontal axis to flip the geometry of the lower handle to have the geometry of the upper handle.

FIG. 38 shows the device 137 with the single handle 140 that swivels about a side to side horizontal axis 143 which can then be used as both the lower handle 104 and the upper handle 105. The handle can be fixed in any position about the axis 143 or it can swivel freely. FIG. 38 shows the swivel handle 140 in the position to be used as the lower handle 104.

Figure 39:
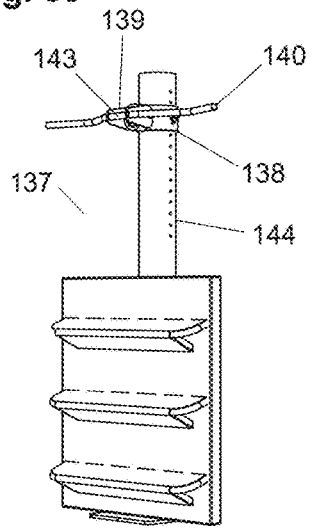

FIG. 39 shows the device 137 with the swivel handle 140 rotated 90 degrees about the pivoting axis 143.

Figure 40:
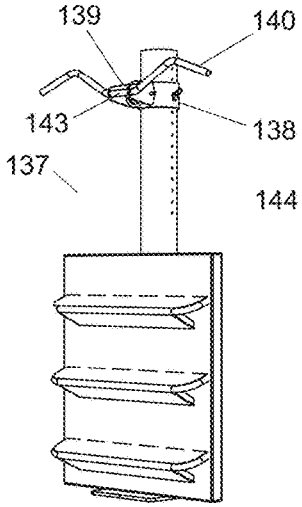

FIG. 40 shows the device 137 with the swivel handle 140 rotated 180 degrees from the original position in FIG. 38. FIG. 40 shows the handle 140 in the position where it can be used as the upper handle 105.

Figure 41:
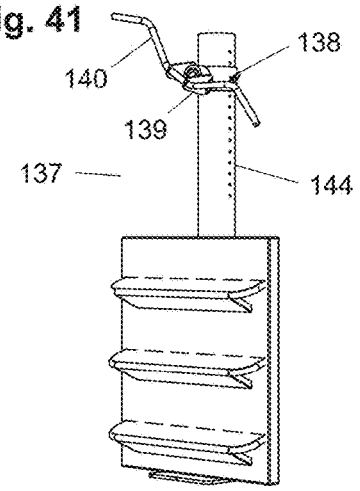
FIGS. 41 and 42 are diagonal views of the device with the single swivel handle that also rotates about a front to back horizontal axis.

FIG. 41 illustrates the handle 140 pivoting 45 degrees down to the right.

Figure 42:
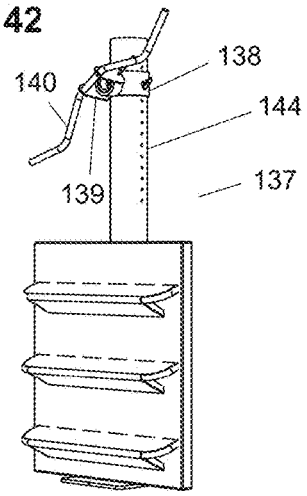

FIG. 42 illustrates the handle 140 pivoting 45 degrees down to the left.

Figure 43:
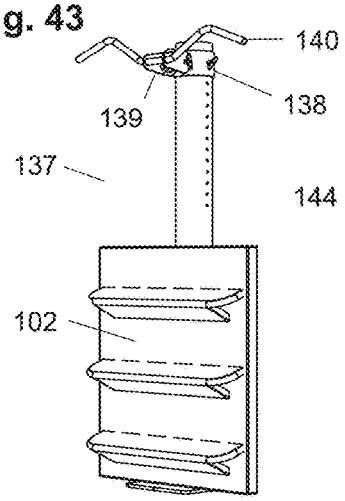
FIGS. 43, 44 and 45 are diagonal views of the device with the single swivel handle that also slides up and down vertically.

FIG. 43 illustrates the handle 140 and pivot assembly 139 attached to the vertical slide 138 at its highest vertical position.

Figure 44:
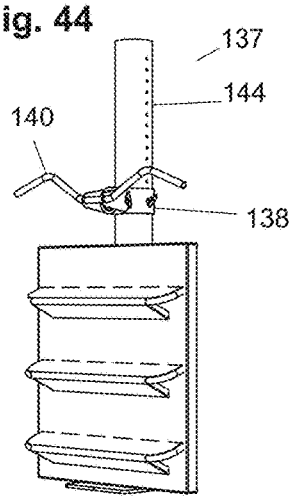

FIG. 44 illustrates the handle 140 and the pivot assembly 139 attached to the vertical slide 138 at its lowest vertical position.

Figure 45:
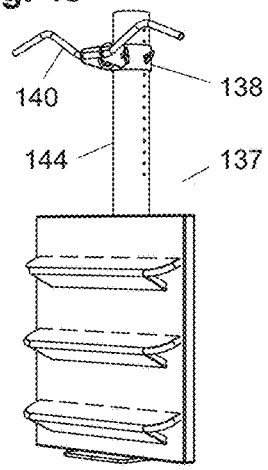

FIG. 45 illustrates the handle 140 and the pivot assembly 139 attached to the vertical slide 138 at a position below the highest vertical position.

The handle 140 can be attached to a pivoting assembly 139 that rotates about a front to back horizontal axis. The swivel handle 140 and the pivoting assembly 139 can be attached to a vertical slide 138 that moves up and down along the vertical post 144. The slide 138 can be fixed in position at any height or slide freely up and down.

Figure 46:
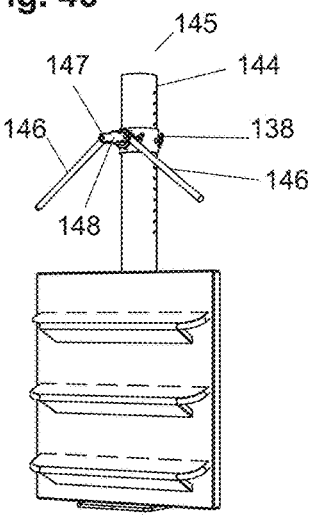
FIGS. 46, 47, 48, 49, 50, 51, and 52 are diagonal views of the device with a two-part handle with right and left handles that can pivot to any angle about a front to back horizontal axis independent of each other.

FIG. 46 shows the device configuration 145 with two individual and identical straight bars that can each independently rotate about a front to back horizontal axis 147. In FIG. 46 the two straight bars 146 are angled downward at the same inside angle of the lower handle 104 or outside angle of handle 105.

Figure 47:
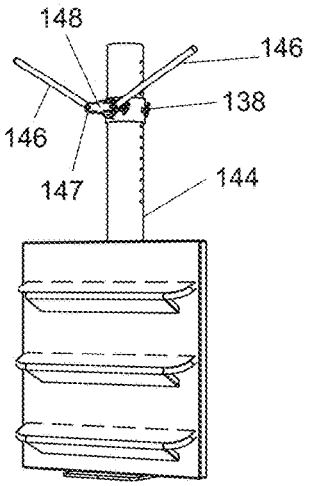

FIG. 47 shows the two straight bars 146 angled upward at the same outside angle of lower handle 104 and the inside angle of upper handle 105.

Figure 48:
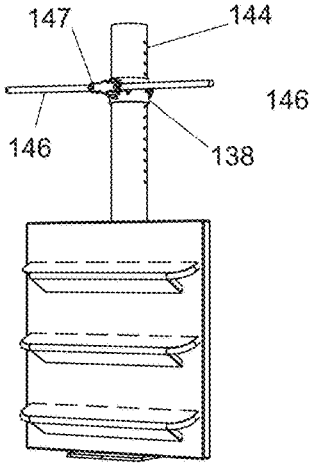

FIG. 48 shows the two straight bars 146 in-line with each other horizontally.

Figure 49:
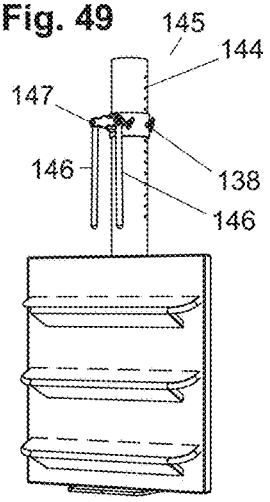

FIG. 49 shows the two straight bars 146 angled downward and parallel to each other.

Figure 50:
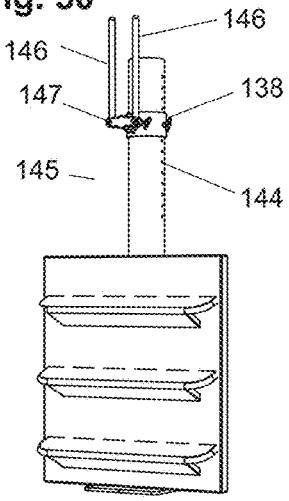

FIG. 50 shows the two straight bars 146 angled upward and parallel to each other.

Figure 51:
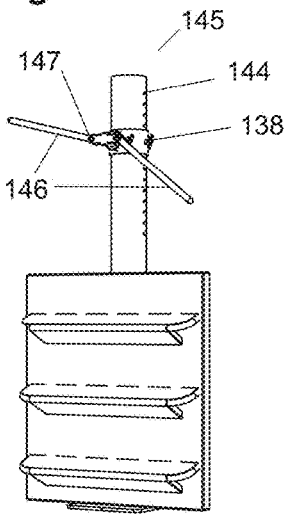

FIG. 51 shows one straight bar 146 angled down at the same inside angle of the lower handle 104 and the other straight bar angled up at the same inside angle as the upper handle 105.

Figure 52:
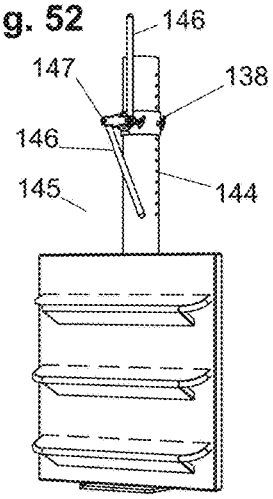

FIG. 52 shows one straight bar 146 up and vertical and the other straight bar 146 rotated down and past vertical at an angle crossing over the post 144.

Figure 53:
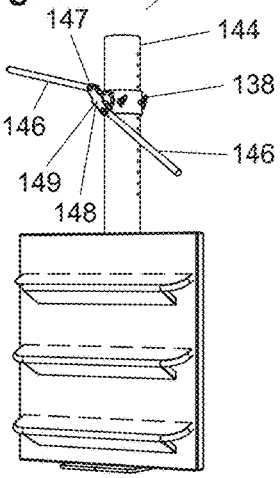
FIG. 53 is a diagonal view of the device with the two-part handle that additionally rotates about a front to back horizontal axis.

FIG. 53 shows the two straight bars 146 attached to a center assembly 149 that rotates about a front to back horizontal axis 148. The assembly 149 can be rotated and fixed in any position or rotate freely.

Figure 54:
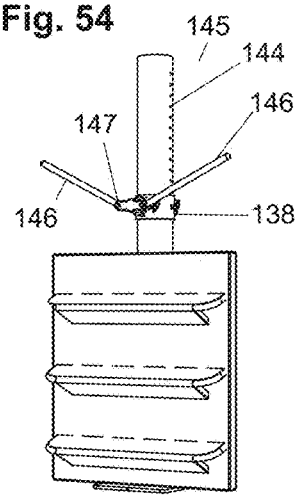
FIG. 54 is a diagonal view of the device with the two-part handle that can slide up and down vertically.

FIG. 54 shows device 145 with the straight bars 146 attached to the pivot assembly 149 attached to the vertical slide 138 set at the lowest position on the post 144. FIGS. 46 through 54 illustrate the device's 145 ability to duplicate any of the aforementioned handles or handle arrays at any given dimension and height, with all the pivoting and slide features all in one mechanism.

Figure 55:
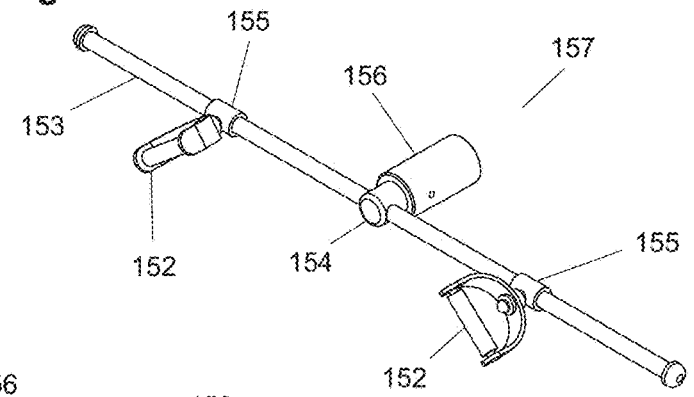
FIG. 55 is a diagonal view of a multi axis two-handle assembly that can rotate about three different axes and the handles can slide in and away from the center independently of each other allowing the handle positions to be infinite about the vertical plane.
Figure 56:
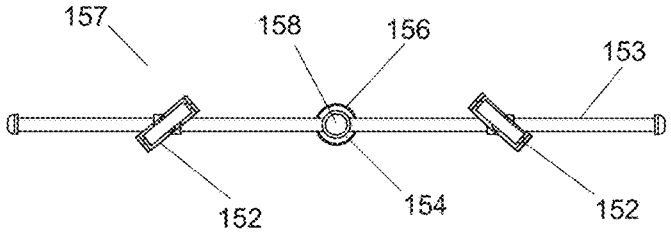
FIGS. 56, 57, 58 and 59 are front views of the handle assembly of FIG. 55, illustrating a few of the possible handle positions and combinations.
Figure 57:
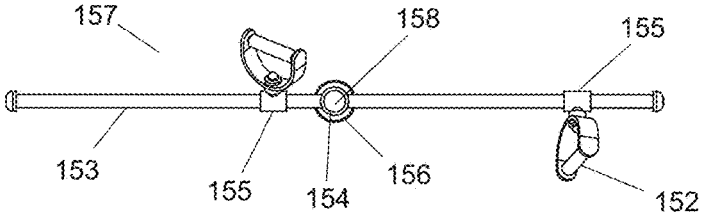
Figure 58:
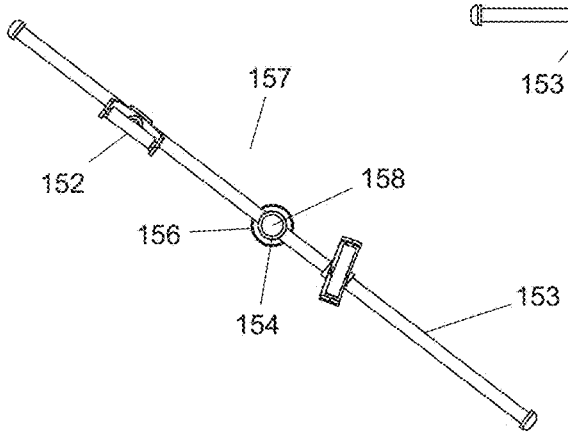
Figure 59:
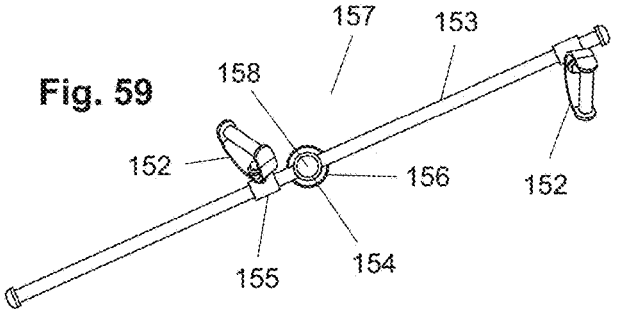
Figure 60:
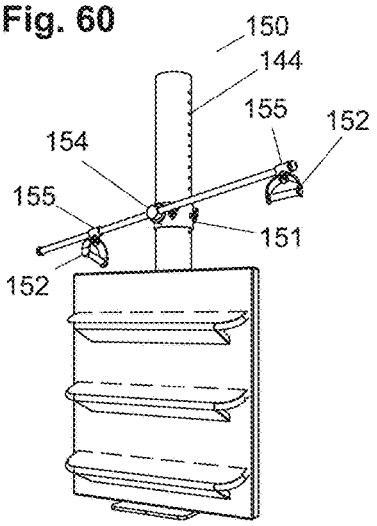
FIGS. 60, 61 and 62 are diagonal views of the multi axis two-handle assembly attached to the device both rotating on the handle assembly's axes and sliding up and down vertically.
Figure 61:
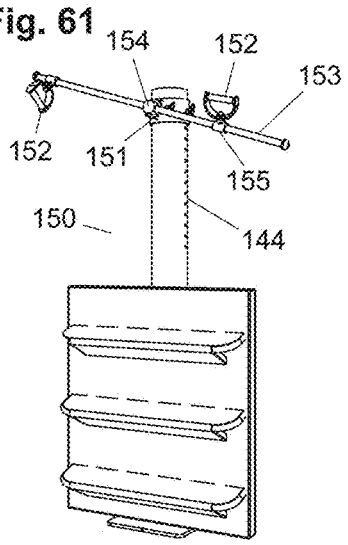
Figure 62:
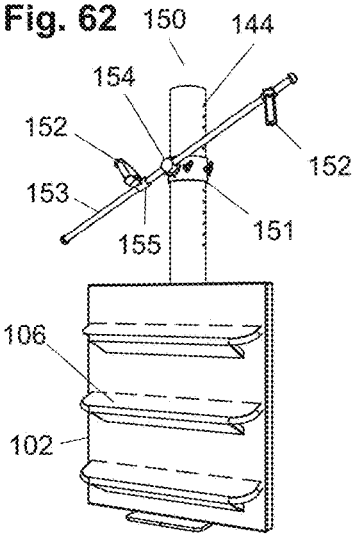

FIG. 55 is a diagonal view of a handle assembly 157 that is made up of two handles 152 that may freely rotate and slide independently into any desired and possible position and/or alignment. The handle 152 pivots on the slide 155. The slide 155 slides along and rotates around the slide bar 153. The slide bar has a center pivot axle 154 that rotates inside a horizontal axis tube 156.

FIGS. 56, 57, 58, 59, 60, 61, and 62 illustrate just a few of the endless handle and assembly positions that can be produced with the handle assembly 157 about a vertical plane parallel to the front surface of the foot support array 102.

Figure 63:
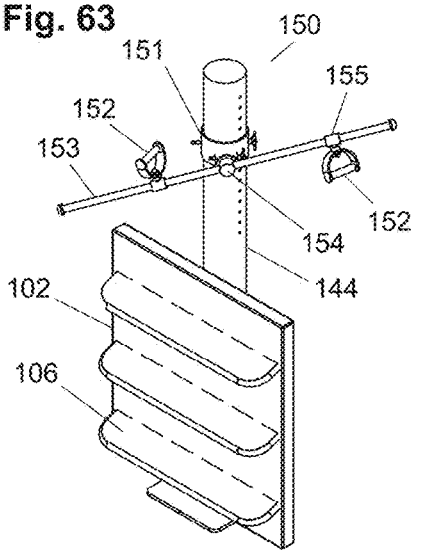
FIGS. 63 and 64 are diagonal views of the multi axis two-handle assembly attached to the device both rotating on the handle assembly's axes and sliding up and down vertically, while also rotating about a vertical axis.

FIG. 63 is a diagonal view of the device 150 that shows the handle assembly 157 rotated to the right around the vertical axis of the post 144. The slide 157 can move up and down and around the post 144.

Figure 64:
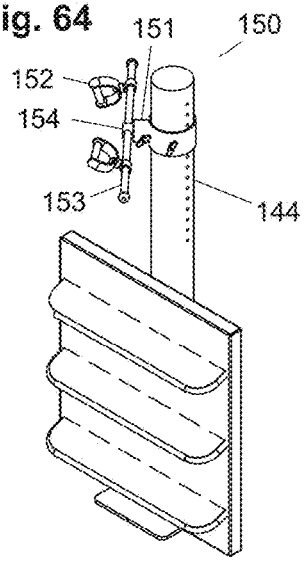

FIG. 64 is a diagonal view of the device 150 that shows the handle assembly 157 rotated to the left around the vertical axis of the post 144 and moved up to a higher position on the post 144.

Figure 65:
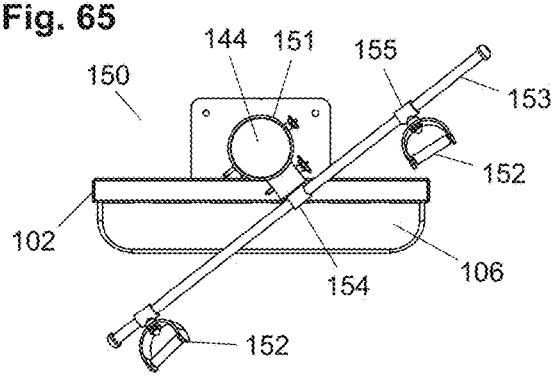
FIGS. 65 and 66 are top views of the multi axis two-handle assembly attached to the device rotating about a vertical axis in two different positions.

FIG. 65 is a top view of the device 150 with the handle assembly 157 rotated to the right on the vertical axis of the post 144.

Figure 66:
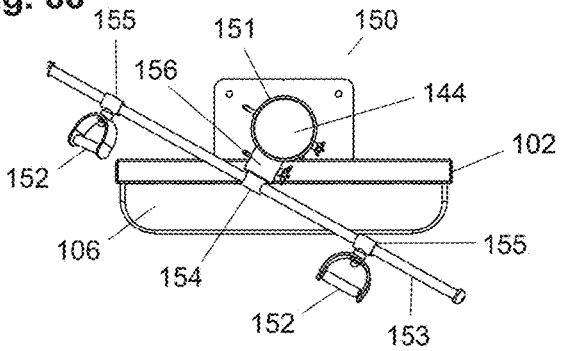

FIG. 66 is a top view of the device 150 with the handle assembly 157 rotated to the left of the vertical axis of the post 144. FIGS. 63, 64, 65 and 66 illustrate the device's 150 ability to create an endless combination of handle positions on multiple planes.

Figure 67:
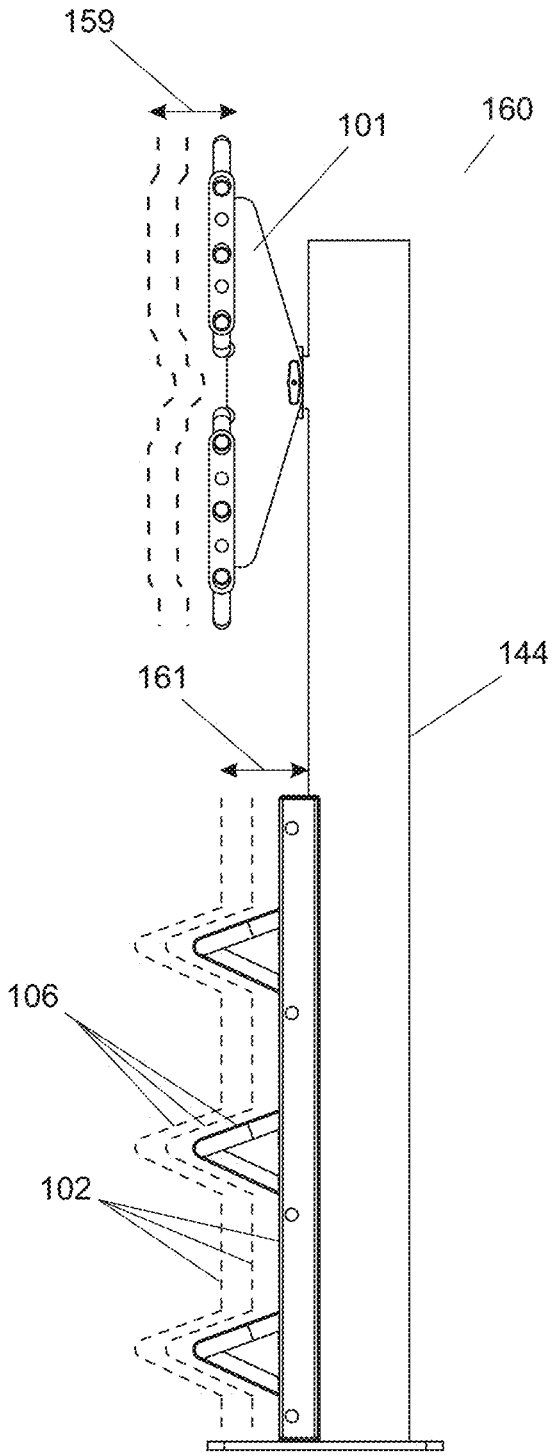
FIG. 67 is a side view of the device illustrating the horizontal vibration and distance of movement front to back.

FIG. 67 is a side view of one device configuration 160 that has a horizontal vibration system. The horizontal vibration can be isolated to just the handle array 101 or the foot support assembly 102, moving either or both forward and back from the front of the device as well as side-to-side or through a looped pathway (e.g., circular motion). The horizontal vibration can be further isolated to just one or two of the handles within the handle array 101 or just one or two of the foot supports 106 of the foot support array 102. The vibration motion or distance of movement 159 front to back can be adjusted to any desire dimension and made to move as fast or slow as desired. The forward and back vibration threatens the user's grip on the handles of the device 160 without the threat of any of the tissue damage that can result with vertical vibration. The directional movement of components by the horizontal vibration system in the horizontal plane may also be side-to-side or through a looped pathway. For example, a looped pathway may comprise a circular motion in the horizontal plane at any diameter or revolution speed. The horizontal vibration adds another element of physical challenge to the vertical exercise or movement to any device configuration of handles and foot supports increasing intensity and muscle recruitment. Examples of devices that may be used for the horizontal vibration system to generate displacement and vibration of the handles and/or foot supports include, but are not limited to, brushed/brushless electromagnetic motors with eccentric rotating mass (ERM) actuators or linear resonant actuators (LRA) and/or eccentric shaft vibrating mechanisms attached to the slide or shaft axis pushing forward and then pulling backwards in a straight line or radially about another axis.

The device being able to utilize any shape of handle if desired in certain embodiments, whether straight or completely round like a steering wheel, or any shape or combination of shapes set in a static position or made adjustable in height or rotation or allowed to move freely in any or all directions, comprises one aspect of the present disclosure.

FIGS. 68, 69,70 and 71 show the device 162 with an extended vertical post 170 and an adjustment receiver tube 168 built into the top of the post 170 that a safety lanyard and/or lifting system can be attached. In one embodiment the receiver tube 168 accepts a horizontal support tube 167 that has a manual or automatic remote controlled hoist or winch 163 attached to the top. The winch 163 has a cable 164 that runs through the end of the tube 167 and around a pulley wheel 166. The cable 164 then runs down and connects to a safety harness 165 and a connecting point 169 that is mid-torso or higher on the user 171. The device 162 can safely lift a person 171 up out of a wheel chair and remain attached to the user 171 while doing vertical exercises or movements to assist the user in stabilizing themselves during the vertical exercises or movements, thereby allowing a person 171 that would normally not be able to enjoy the neurological and physiological benefits of vertical exercise and movements to do so. The winch 163 and the cable 164 attached to the safety harness 165 also acts as a safety system and fall protection in case the user or rehab patient 171 fatigues too fast and loses their grip on the device 162. The user 171 will be stopped from falling and can easily stabilize themselves and establish another grip on the device 162 and continue vertical exercises or movements, or the user can be safely lowered back into their wheel chair with no risk of injury to the user 171 or their care giver. As a safety system, it can be used for any user 171 that is not in a wheel chair but desires the security of being attached to the device 162 and unable to fall. The support tube 167 can be adjusted to position the cable pulley 166 closer or farther away from the post 170 to equally accommodate any size and girth of user.

Figure 68:
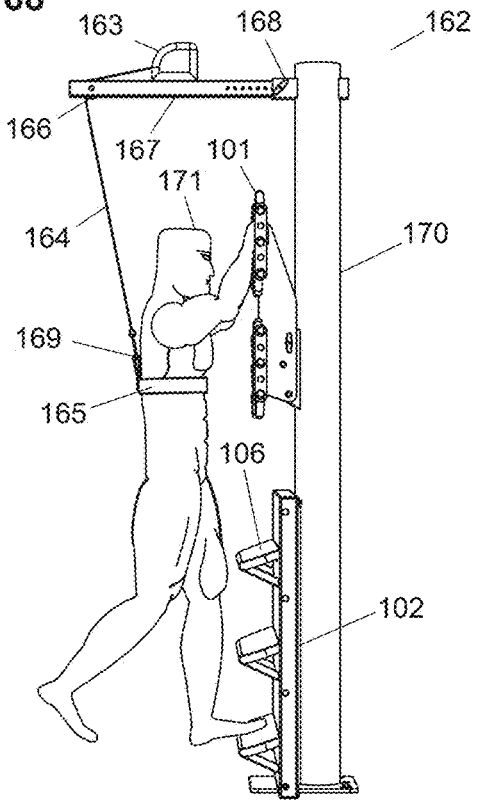
FIGS. 68 and 69 are side and diagonal views, respectively, of the device with a six-handle array and a built in safety system and winch.

FIG. 68 is a side view of the device 162 utilizing the six-handle array 101.

Figure 69:
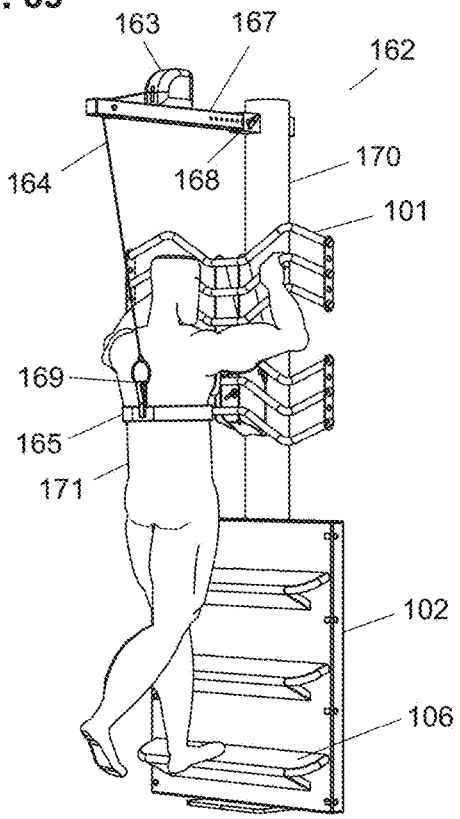

FIG. 69 is a diagonal view of the device 162 utilizing the six-handle array 101.

Figure 70:
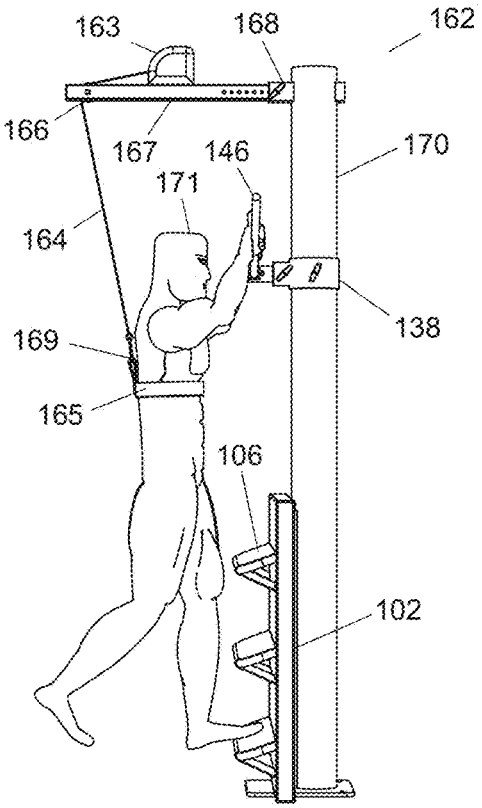
FIGS. 70 and 71 are side and diagonal views, respectively, of the device with a two-part handle and a built in safety system and winch.

FIG. 70 is a side view of the device 162 utilizing the handles 146 on the vertical slide and pivot assembly 138. Any handle configuration or assembly can be used with the safety system device 162.

Figure 71:
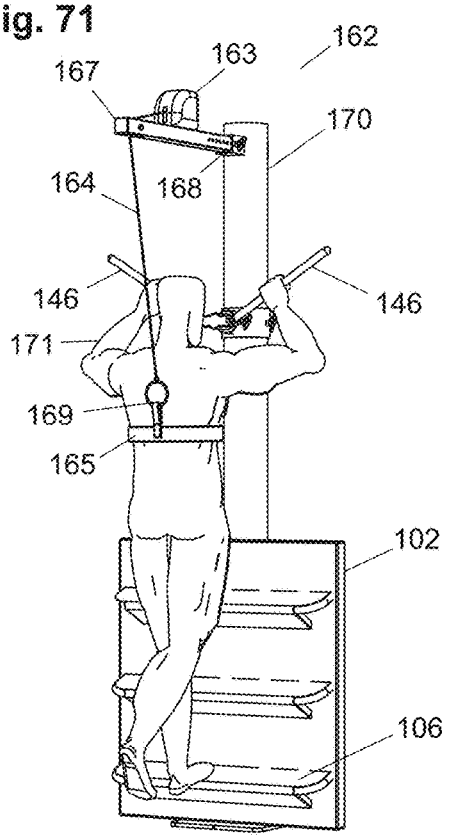

FIG. 71 is a diagonal view of the device 162 utilizing the handles 146 on the vertical slide and pivot assembly 138.

Figure 72:
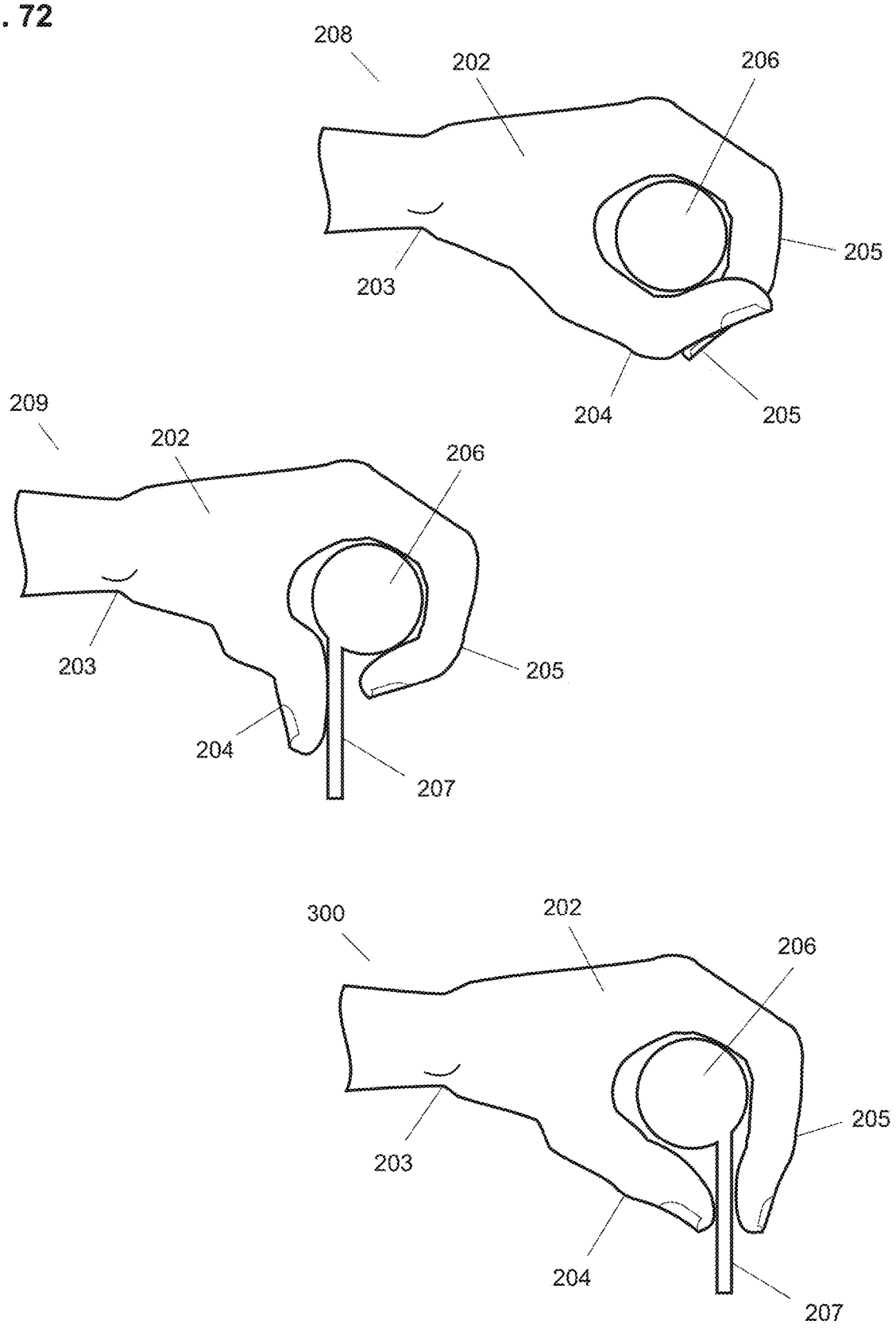
FIG. 72 shows three side views of a hand around a round handle bar and on a handle bar with a thumb control plate in two positions.

FIG. 72 shows a thumb and finger control plate 207 that can be adjusted to change the quality of grip a person can get on the device handle. The top hand and handle 208 is a handle with no control plate 207 and the grip is closed and positive, which can be maintained for long periods of time relative to the person's strength. The middle hand and handle 209 shows the control plate positioned where the thumb is not permitted to close and aid in the quality of grip, but the fingers are permitted to wrap around the surface of the grip creating a semi positive grip which can be maintained for a fairly short time requiring more tension through the fingers and along the tensional lines of muscle leading to the torso. The third hand at the bottom 300 shows the control plate in a position that limits both the thumb and fingers from wrapping around the handle and establishing a positive grip; therefore the grip is threatened and will require more strength to maintain for any period of time.

Figure 73:
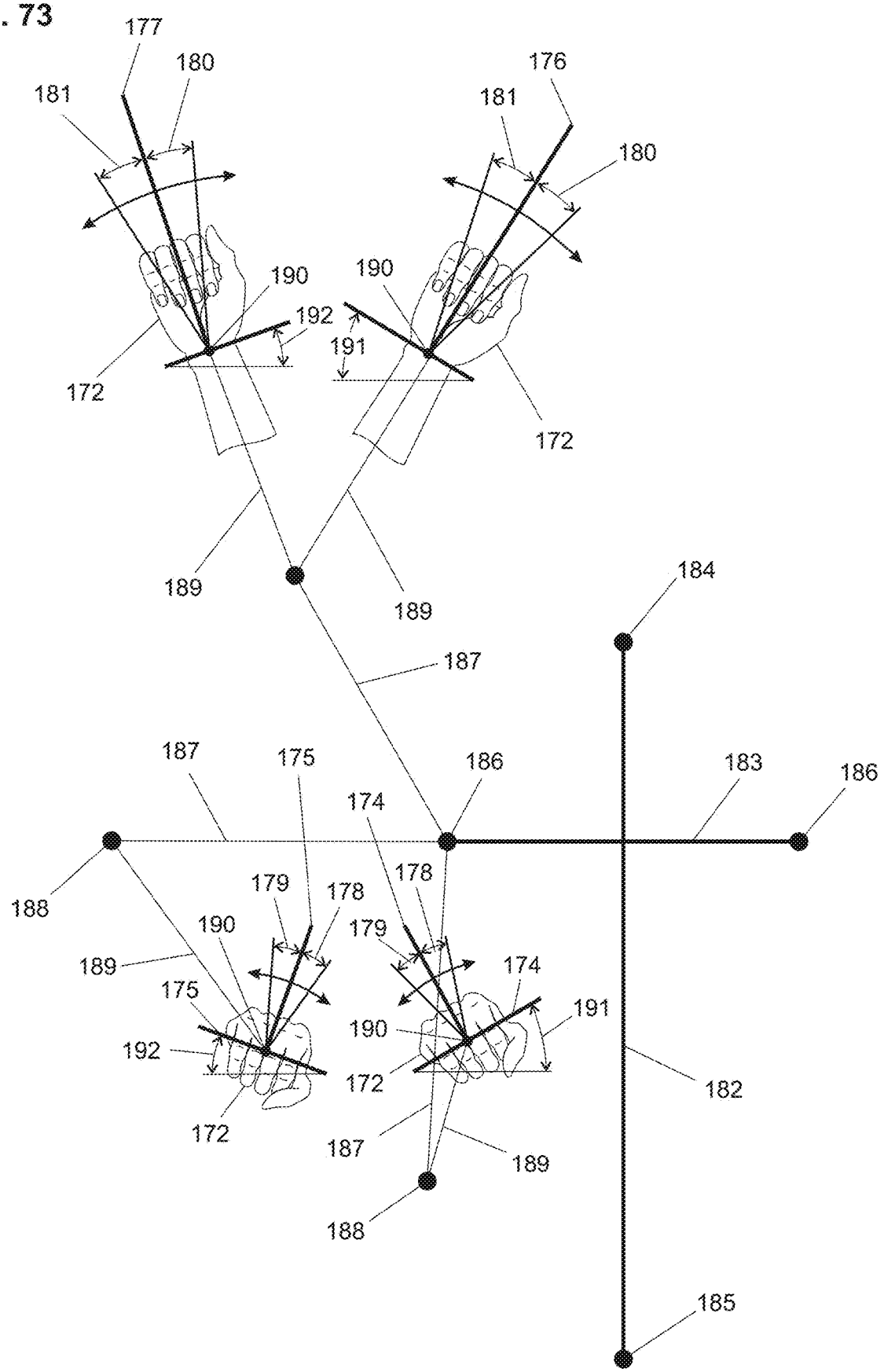
FIG. 73 is a diagram drawing illustrating the natural and neutral position of the hand and wrist in the four required positions to do vertical exercises, and shows the safe range of motion for all four hand positions.

FIG. 73 illustrates the natural position of the hand and wrist in relationship to the position of the arm to the body. In FIG. 73, the right hand 172 is shown angled 191 at 30 degrees from horizontal when the elbow 188 is down, and the hand 172 is at shoulder width apart from the other hand and below or level with the shoulder 186, and the upper arm 187 is down to the side of the torso, which has a vertical spinal alignment 182 and a horizontal shoulder alignment 183 with the head 184 directly above the shoulders 186 and sacrum 185. This is the natural wrist alignment 174 to the forearm 189 and in that alignment position 174, the wrist 190 may pronate 178 or supinate 179 up to 15 degrees from neutral 174 with no discomfort or wrist strain when doing vertical exercise. The wrist 190 is over pronated or supinated if rotated more than 15 degrees from neutral, which over time can produce wrist pain or injury and can prevent the user from continuing to do vertical exercise or movements. It is important to keep the wrist 190 within the safe range of motion during pronation 178 and supination 179 during all vertical exercise and movements in order to make the modality sustainable long term. If kept within the safe range of motion, the user could perform the specific vertical exercise indefinitely.

The neutral angle and alignment 175 for the right hand as shown in FIG. 73 is −20 degrees 192 from horizontal when the hand 172 is positioned more than shoulder 186 width apart and the elbow 188 is out away from the body and at shoulder 186 height.

When the hand 172 and the elbow 188 are above the shoulders and extended outward away from each other, the neutral alignment of the wrist is no longer about the degree of pronation and supination but instead it is about flexion and hyperextension. When the hand 172 is above the shoulder 186 and shoulder width apart from the other hand, the natural alignment 176 is when the hand 172 is in-line 176 with forearm 189. The wrist 190 has 15 degrees of safe flexion 180 and 15 degrees of safe hyperextension 181 as illustrated in FIG. 73. The neutral position 177 and angle of the base of the wrist 190 is −30 degrees 191 from horizontal when the hand is shoulder width and 20 degrees 192 from horizontal when the hand 172 is more than elbow 188 width when the elbows are up and across from each other, like when doing a traditional wide grip pull-up for example.

Figure 74:
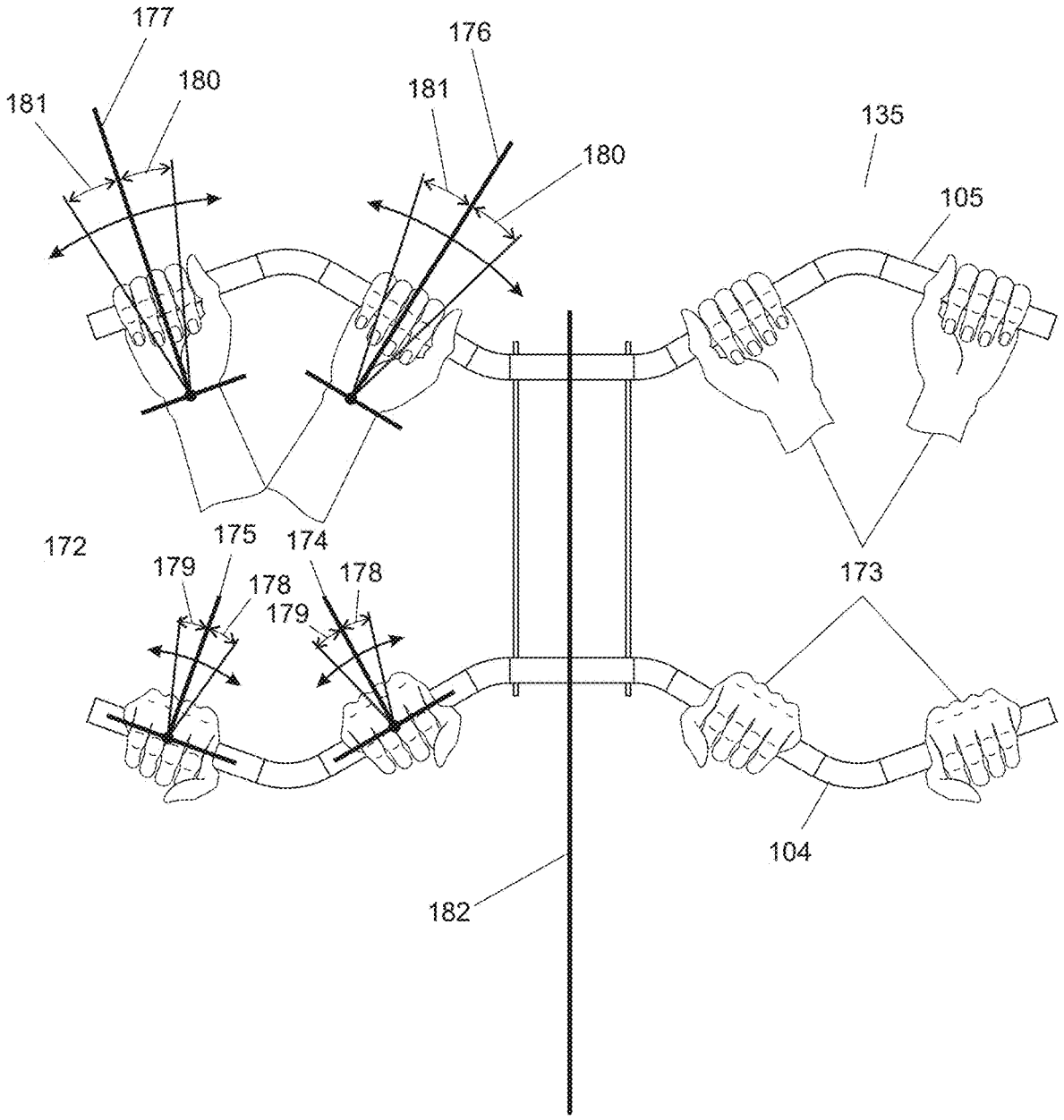
FIG. 74 is a diagram drawing that illustrates that the device's handle bar shape was specifically designed to accommodate all four hand positions when gripping and holding on to the device, and that the shape of the lower and upper handles keep the hand and wrist in the neutral position and within the safe range of motions.

FIG. 74 addresses the fact that all vertical exercises and movements require the hands to be in one of the four positions described above, and FIG. 74 shows that the handles of the device were specifically designed to match the natural alignment of the hand and wrist so that the user can continue to do vertical exercise and movements long term without abusing the hand and wrist range of motion making the modality truly sustainable for any age user. In some embodiments, the grips of each handle position may be approximately 5.5 inches (about 14.0 cm) in length to accommodate a range of different users. The width of the entire handlebar assembly should be at more than shoulder width in dimension to accommodate each position for vertical exercise within the safe range of motion for a user's wrist. In certain embodiments, the width of the entire handlebar assembly may be approximately 36 inches (about 91.4 cm), although the assembly may be sized up or down for the requirements of a specific user.

Figure 75:
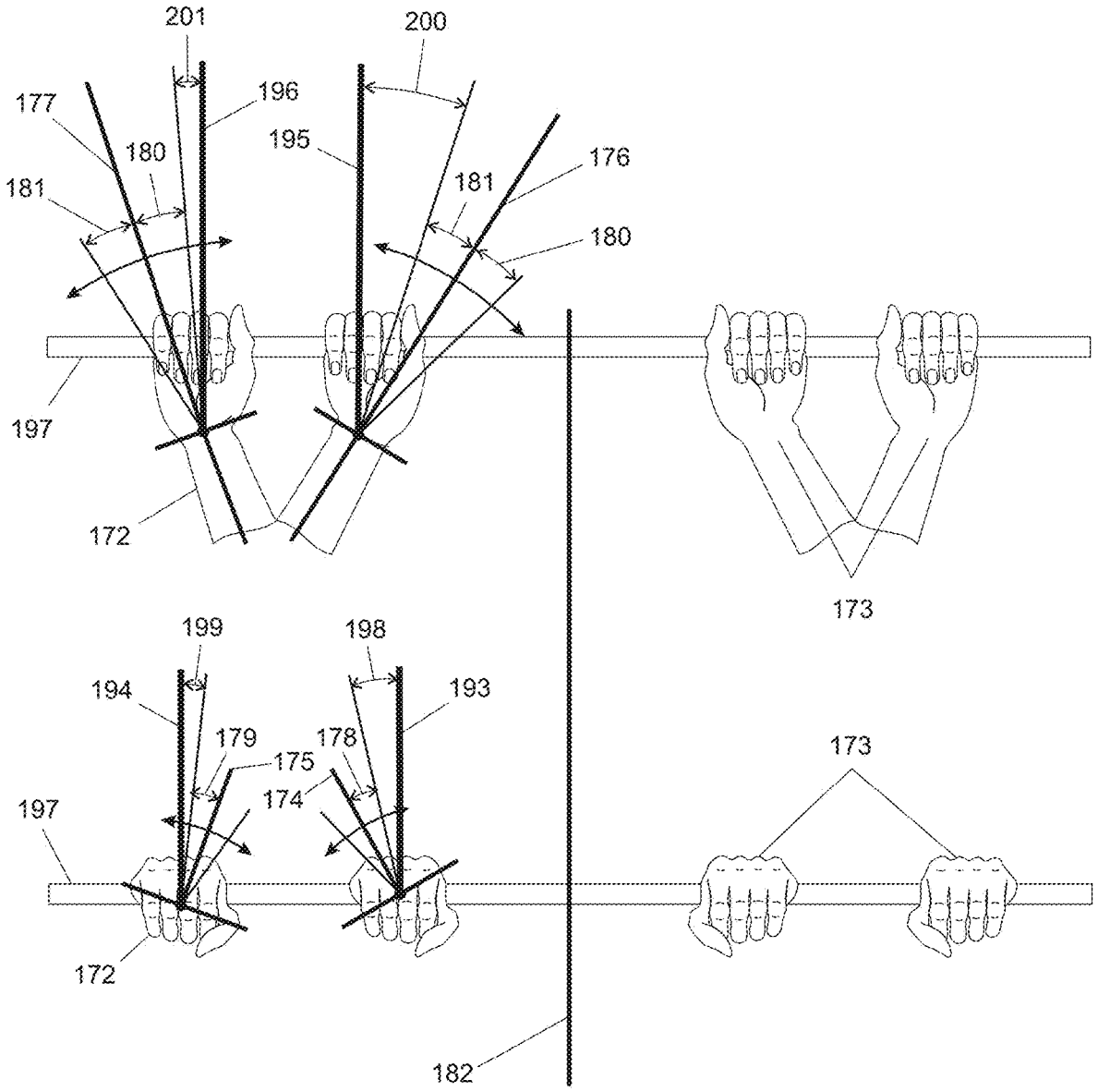
FIG. 75 is a diagram drawing that illustrates the over rotation and extension of the hand and wrist when holding on to a straight bar handle, and shows that the hand and wrist in all four vertical gripping positions force the wrist beyond the safe range of motion.

FIG. 75 shows the over pronation 198 of the wrist 190 from the neutral hand alignment 174 when the hand 172 is forced to grip onto a straight bar or handle 197 with the hand positioned below the shoulder and at shoulder width. The over supination 199 of the wrist 190 with the hand 172 wider than shoulder width and elbows high and outward from the torso is also shown. The tremendous amount of over hyperextension 200 is shown with hands above shoulder and at shoulder width, and the over flexion 201 of the wrist 190 is shown when the hands are above the shoulders and wider than the shoulders. All four of the required hand positions for vertical exercise and movement, when done with a straight bar or straight edge handles in prior art apparatus, forces the wrist outside its safe range of motion and overtime can cause intolerable pain or injury making it impossible to sustain the use long term.

FIGS. 76, 77, 78 and 79 are illustrative of the current art of vertical exercise apparatuses showing their limited and detrimental features.

The invention solves many of the problems and design flaws of known apparatuses, as well as incorporates innovative features and functions creating a unique, flexible and multifunctional device that make the modality of vertical exercise and movement sustainable and safe for all ages.

Figure 76:
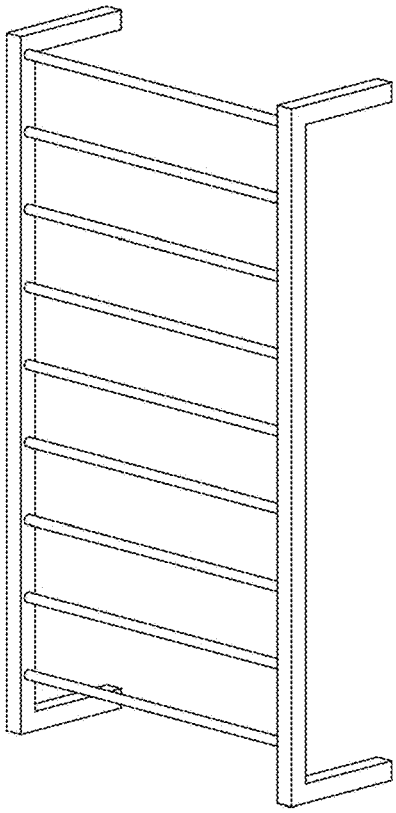
Fig. 76 (Prior Art)
FIG. 76 is a diagonal view of a prior art apparatus that can be used for vertical exercise that has round straight bars that act as both the handle and foot supports.

FIG. 76 shows prior art of a ladder style apparatus with straight bar handles. The wrist when using the apparatus is forced to rotate into a horizontal alignment and beyond an acceptable long-term range of motion (hyperextension) for the wrist. With this type of apparatus, there is a minimal amount of surface contact made between the foot and the foot support, thereby creating a thin line of contact that produces a tremendous amount of focused pressure on the tissues and bones of the foot wherever contact is made. The open area between foot supports gives no control of foot placement and cannot stop the user's foot from slipping past and off the foot support resulting in injury to the user. All hand and foot supports are static and non adjustable.

Figure 77:
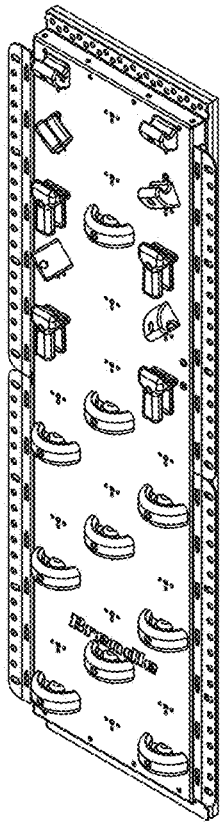
Fig. 77 (Prior Art)
FIG. 77 is a diagonal view of a prior art apparatus that has small and defined positions for the hands and feet, with very little contact surface for the foot and the hand grip causing them to be extremely threatened with no positive grip for sustainable exercise.

FIG. 77 shows a prior art climbing wall style apparatus with very limited hand and foot position options that forces all users of all sizes to conform to its geometry. This type has very little hand and foot surface contact and creates tremendous joint and ligament strain during use and after. All hand and foot supports are static and non adjustable without tools and taking the apparatus out of use.

Figure 78:
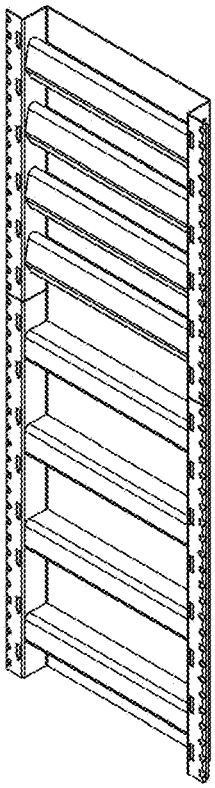
Fig. 78 (Prior Art)
FIG. 78 is a diagonal view of a prior art apparatus that has stationary step style foot supports with flat horizontal top surfaces, and stationary straight and flat edge style hand grips that do not permit a positive and sustainable grip.

FIG. 78 shows prior art of a wall shelf style apparatus that has straight edges for gripping with hands that minimize the user's ability to establish a positive hold on to the apparatus, thereby creating tremendous finger and wrist strain while also forcing the wrist to exceed safe ranges of motion required for long term use and avoidance of injury. The foot supports have horizontal flat step style support surfaces that do not allow the front pad of the foot to establish any area of surface contact because, when doing vertical exercise, the foot cannot hyperextend enough for the bottom surface area of the foot to interface with the top flat horizontal surface of the foot support step. Therefore, all the weight and forces are focused onto the edge of the foot support and along a thin line of contact area on the user's foot forcing the foot to conform as much as it can to the edge of the step. The focus line of pressure over time can damage tissues and joints in the foot, and eventually will force the user to discontinue the use of the apparatus for a while or indefinitely. All hand and foot supports are static and non adjustable.

Figure 79:
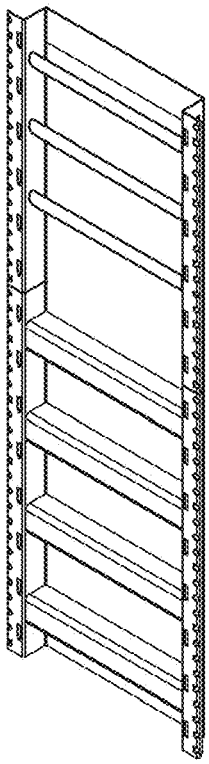
Fig. 79 (Prior Art)
FIG. 79 is a diagonal view of a prior art apparatus that has stationary flat step style foot supports and stationary straight round handles.

FIG. 79 is a prior art apparatus that is also a wall shelf style that uses the horizontal flat foot supports like in FIG. 78. FIG. 79 also shows the apparatus with a symmetrical array of statically positioned straight bars for handles that force the wrist beyond the safe range of motion when holding onto the apparatus during any of the vertical exercises. All hand and foot supports are static and non adjustable.

All current types of vertical exercise apparatus force the body's arms, legs, hands and feet in certain positions that create negative strain on muscles and ligaments and restrict proper blood flow and neurotransmission. Repetitive and/or long-term strain and restriction can cause long term or permanent injury or damage to the body. One example is the slight rotation and bend put in the wrist when typing on a typical keyboard. The ever so slight strain over time can produce injury, one being carpal tunnel syndrome. So it is vital that when putting the body under repetitious movement that the body's joints are in as neutral a position as possible, which means the muscles and ligaments all around the joints are as close to balanced or equal contraction and tension having as close to normal balance of blood flow and neurotransmission as possible to avoid injury. Current prior art vertical exercise apparatuses cause over pronation, supination, flexion or hyperextension that could restrict flow through a joint and/or result in an impingement. The prior art requires the user's body to conform to the form of the apparatus and the apparatus cannot conform its form to the user.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations, which are within their true spirit and scope. Each embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all combinations and sub-combinations possible of the group are intended to be individually included in the disclosure.

In general the terms and phrases used herein have their art-recognized meaning, which can be found by reference to standard texts, journal references and contexts known to those skilled in the art. The above definitions are provided to clarify their specific use in the context of the invention.

The invention claimed is:

1. A vertical exercise device comprising:

one or more foot supports, each having a support surface which is substantially flat, wherein the support surface is inclined between a front edge of the support surface and a back end of the support surface at an angle relative to a horizontal plane, with a depth of the support surface extending between the front edge and the back end being dimensioned to contact a ball of a user's foot;

a toe stop surface vertically positioned along the back end of the support surface of the one or more foot supports, the toe stop surface configured to prevent a user's foot from slipping forward off the one or more foot supports during use;

one or more lower handlebars arranged above the one or more foot supports, each of the one or more lower handlebars comprising multiple angled portions; and one or more upper handlebars arranged above the one or more lower handlebars, each of the one or more upper handlebars comprising multiple angled portions, wherein said multiple angled portions of the one or more upper handlebars have an opposite orientation to the multiple angled portions of the one or more lower handlebars with respect to a transverse plane extending between the one or more upper handlebars and the one or more lower handlebars.

2. The vertical exercise device of claim 1, wherein the one or more foot supports comprise a plurality of foot supports which are aligned and spaced apart from one another in a vertical direction.

3. The vertical exercise device of claim 2, wherein the plurality of foot supports comprise three foot supports.

4. The vertical exercise device of claim 1, wherein the front edge of the support surface has rounded corners.

5. The vertical exercise device of claim 1, wherein the angle at which the support surface is inclined is between 0 and 35 degrees.

6. The vertical exercise device of claim 5, wherein the angle at which the support surface is inclined is approximately 20 degrees.

7. The vertical exercise device of claim 1, wherein the one or more upper handlebars and the one or more lower handlebars are vertically adjustable.

8. The vertical exercise device of claim 1, wherein the multiple angled portions of the one or more upper handlebars include a center portion attached on each side to an upward-angled inner side portion which is attached to a downward-angled outer end portion, and wherein the multiple angled portions of the one or more lower handlebars include a center portion attached on each side to a downward-angled inner side portion which is attached to an upward-angled outer end portion.

9. The vertical exercise device of claim 1, wherein the one or more upper handlebars and the one or more lower handlebars are together part of a handlebar array device.

10. The vertical exercise device of claim 9, wherein the handlebar array device comprises three upper handlebars and three lower handlebars.

11. The vertical exercise device of claim 9, further comprising a center post, wherein the one or more foot supports are vertically arranged along the center post, and the handlebar array device is mounted to the center post above the one or more foot supports in a vertical plane extending parallel to a vertical axis of the center post.

12. The vertical exercise device of claim 11, wherein the handlebar array device comprises three upper handlebars and three lower handlebars.

13. The vertical exercise device of claim 11, wherein the multiple angled portions of the one or more upper handlebars include a center portion attached on each side to an upward-angled inner side portion which is attached to a downward-angled outer end portion, and wherein the multiple angled portions of the one or more lower handlebars include a center portion attached on each side to a downward-angled inner side portion which is attached to an upward-angled outer end portion.

14. The vertical exercise device of claim 11, wherein the handlebar array device is pivotable from an upright position in the vertical plane into an inclined position such that the one or more upper handlebars are positioned horizontally further from the center post than the one or more lower handlebars.

15. The vertical exercise device of claim 11, wherein the handlebar array device is horizontally adjustable relative to the center post.

16. The vertical exercise device of claim 11, wherein the handlebar array device is vertically adjustable along the center post.

17. The vertical exercise device of claim 11, wherein the handlebar array device is rotatable relative to the vertical axis of the center post.

18. The vertical exercise device of claim 11, wherein the handlebar array device is rotatable about a horizontal axis of the handlebar array device.

19. The vertical exercise device of claim 11, wherein the one or more foot supports comprise three foot supports which are aligned and spaced apart from one another in a vertical direction.

20. The vertical exercise device of claim 11, wherein the front edge of the support surface has rounded corners.

* * * * *